US006708971B1

(12) United States Patent
Sasaki et al.

(10) Patent No.: US 6,708,971 B1
(45) Date of Patent: Mar. 23, 2004

(54) PAPER CASSETTE, PRINTER FOR USE WITH PAPER CASSETTE, AND PAPER SUPPLYING METHOD

(75) Inventors: Hidemi Sasaki, Asaka (JP); Akimasa Kaya, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/646,449

(22) PCT Filed: Apr. 8, 1999

(86) PCT No.: PCT/JP99/01857

§ 371 (c)(1),
(2), (4) Date: Nov. 27, 2000

(87) PCT Pub. No.: WO99/52803

PCT Pub. Date: Oct. 21, 1999

(30) Foreign Application Priority Data

Apr. 14, 1998 (JP) ..... 10/102959
Apr. 27, 1998 (JP) ..... 10/117094
Dec. 2, 1998 (JP) ..... 10/343409

(51) Int. Cl.[7] ..... B65H 3/06
(52) U.S. Cl. ..... 271/117; 271/122; 271/162
(58) Field of Search ..... 271/162, 117, 271/121, 122

(56) References Cited

U.S. PATENT DOCUMENTS 6,460,845 B1 * 10/2002 Sasaki et al. ..... 271/121

FOREIGN PATENT DOCUMENTS

| | | | | |
|---|---|---|---|---|
| JP | 60-2533 A | * | 1/1985 | |
| JP | 64-53150 U | * | 4/1989 | |
| JP | 3-41730 U | * | 4/1991 | |
| JP | 5-116774 A | * | 5/1993 | |
| JP | 6-48584 A | * | 2/1994 | |
| JP | 9-132330 | | 5/1997 | ..... B65H/1/26 |
| JP | 10-279110 A | * | 10/1998 | |

OTHER PUBLICATIONS

Patent abstract of Japan 09132330 A, May 20, 1997.

* cited by examiner

*Primary Examiner*—David H. Bollinger
(74) *Attorney, Agent, or Firm*—Sughrue Mion, PLLC

(57) ABSTRACT

A paper supplying method for supplying recording sheets from a paper cassette to a printer including rotating the paper supply rollers to feed the recording sheet into the printer in response to a print start command and rotating the paper supply rollers after an end of paper supply to return other recording sheets to a predetermined paper supply start position; or, rotating the paper supply rollers in response to a print start command, detecting the recording sheets which protrude from a predetermined paper supply start position, and returning those recording sheets to the paper supply start position; or, rotating the paper supply rollers to feed the recording sheet in response to a print start command, detecting that the paper cassette is loaded, and rotating the paper supply rollers to return the recording sheets to a paper supply start position at each loading of the cassette.

5 Claims, 25 Drawing Sheets

PAPER CASSETTE, PRINTER FOR USE WITH PAPER CASSETTE, AND PAPER SUPPLYING METHOD

FIELD OF THE ART

The present invention relates a paper cassette and a printer for use with the paper cassette. The present invention relates also to a method of supplying recording sheets from the paper cassette to the printer.

BACKGROUND ARTS

Among printers, thermal printers are classified into thermosensitive printers and thermal transfer printers, each of these two types uses a specific kind of recording paper. Recording paper for the thermosensitive printer has a cyan thermosensitive coloring layer, a magenta thermosensitive coloring layer, and a yellow thermosensitive coloring layer formed sequentially atop another on a base material. The thermosensitive coloring layers are subjected to thermal recording sequentially from the obverse side, while being optically fixed before the next thermosensitive coloring layer is subjected to the thermal recording. The optical fixing is disabling coloring-capability of the individual thermosensitive coloring layer by exposing it to electromagnetic rays of a specific wavelength range, e.g. ultraviolet rays, that is determined for each thermosensitive coloring layer, so that already colored thermosensitive coloring layers will not be re-colored by the thermal recording on the next thermosensitive coloring layer. Because coloring characteristics of the recording paper for the thermosensitive printer are affected even by light from ordinary light sources if the recording paper is exposed for a long time, the recording paper is preserved in a light-tight bag, and the light-tight bags are encased in a paper box when the recording paper is shipped out of factory.

On the other hand, the thermal transfer printers are classified into a melting type where ink is melted or softened to be transferred from ink film onto the recording paper, and a sublimation type where dyes on an ink film are transferred onto the recording paper by sublimation or dispersion. For the melting type printer, a high-smooth coated paper is used as the recording paper. For the sublimation type printer, a specific paper coated with polyester resin is used as the recording paper. The recording paper for these thermal transfer printers is contained in a moisture-proof bag, and the bags are contained in a paper box at the shipment.

To load the recording sheets in a printer, first the bag is opened to take out. There is a recording sheet package that contain a stack of sheets of recording paper, and the recording sheet package is loaded in a paper cassette. Then, the paper cassette is placed in the printer, so the recording sheet is fed from the paper cassette into the printer. The paper cassette has an air-proof sponge or the like along a mating portion between a cassette body and a lid, for protecting the contained recording sheets from moisture, as disclosed for example in JPA 9-132330.

Although the above mentioned paper cassette is completely closed in its preservative condition where the lid is closed, but the lid must be opened for paper-feeding, then the moisture-shielding properties of the cassette decreases. Moreover, where the recording sheets are to be fed out from a stack, a trouble of feeding a plurality of recording sheets along with an uppermost one, called multi-feeding, is likely to occur. This trouble can occur at any kinds of recording sheets, including thermosensitive recording sheets.

As a result of multi-feeding, the recording sheets may jam up in a paper feeding path, or recording area on the recording sheet may be deviated. As a result of multi-feeding, leading ends of the multi-fed recording sheets may be left protruded from the paper cassette. Since recording surfaces of the recording sheets are protected from moisture and light by stacking the recording sheets in tight contact with each other, if the recording sheets are left protruded for a long time, coloring characteristics of the recording surfaces of the protruded recording sheets are affected by moisture and light. A change in the coloring characteristics results in undesirable variations in color or density of the recorded image.

The recording sheets can also protrude from a paper supply start position in the paper cassette or in the printer when the paper cassette or the printer with the paper cassette attached thereto is carried about. Also while the paper cassette is being attached to the printer, the recording sheets can protrude from the paper supply start position. If the recording sheets are in this condition at the start of paper feeding, it may cause multi-feeding, and jamming of the recording sheets are likely to occur. The same applies not only to the thermal printers but also to any other kinds of printers.

An object of the present invention is to provide a paper cassette, a printer and a paper feeding method, that prevent multi-feeding and keep protecting the recording surface of the recording sheet from moisture and light.

DISCLOSURE OF THE INVENTION

In a printer supplied with recording sheets one by one from a paper cassette by rotating paper supply rollers, the paper cassette being loaded with a stack of recording sheets, the present invention is characterized by comprising a paper supply roller control device that executes a paper supply mode and a returning mode, wherein the paper supply roller control device causes the paper supply rollers to rotate in a first direction in the paper supply mode, to feed an uppermost or a lowermost one of the recording sheets into the printer, or causes the paper supply rollers to rotate in a second direction in the returning mode, to return the recording sheet to a predetermined paper supply start position inside the paper cassette.

The returning mode is executed after an end of paper supply, when a power source of the printer is turned on, or when the paper cassette is loaded in the printer.

The paper supply mode is executed in response to a print start command. At that time, it is possible to execute the returning mode immediately before the paper supply mode. In that case, the paper supply rollers are rotated in the second direction to return the recording sheets to the predetermined paper supply start position inside the paper cassette before the paper supply rollers are rotated in the first direction to feed the uppermost or the lowermost recording sheet into the printer.

Even if the recording sheets are deviated from the predetermined paper supply start position because of multi-feeding or other reasons, these recording sheets are returned to the initial position, so that occurrence of multi-feeding and jamming of the recording sheets in the next paper supply mode is reduced. Beside that, the recording sheets are kept shielded from moisture and light.

A paper cassette according to the present invention comprises a cassette body loaded with a stack of recording sheets and having a parallelepiped shape with an open end that serves as a paper supply opening; paper supply rollers located in proximity to the paper supply opening of the cassette body in contact with a first one of the recording sheets that is placed at the uppermost or the lowermost position of the stack, the paper supply rollers being rotated to feed the recording sheet out of the cassette body; a recording sheet urging member that pushes the entire stack of the recording sheets to press the first recording sheet onto the paper supply rollers; and a recording sheet separator for separating the first recording sheet from a second and following recording sheets, the recording sheet separator being located in the paper supply opening and movable between a paper separating position where the recording sheet separator is in contact with leading ends of the second following recording sheets, and an open position away from the leading ends of the recording sheets to open the paper supply opening, wherein the first recording sheet is fed out from the cassette body through a paper passageway that is formed between the recording sheet separator and the paper supply opening while the recording sheet separator is in the paper separating position.

According to the present invention, the recording sheets are loaded in the cassette body that has only one end open as the paper supply opening, and the paper supply opening is also closed by the recording sheet separator such that the narrow paper passageway is left unclosed. Because the paper passageway is shielded when the paper cassette is placed in the printer, the paper cassette of the present invention is improved in light- and moisture-shielding properties.

Since the recording sheet separator is movable between the paper separating position where the recording sheet separator is in contact with the leading ends of the second and following recording sheets, and the open position retracted from the paper supply opening, the recording sheet separator in the paper separating position can separate the recording sheets from each other during the paper feeding, thereby preventing multi-feeding. On the other hand, in the retracted position, the recording sheet separator is retracted from the paper supply opening to open up the paper supply opening, so the recording sheets may be loaded through the paper supply opening into the cassette.

The light- and moisture-shielding properties are still more improved by providing the light-shielding member, which is made of a resilient plate bent into a wavy shape, in the paper passageway, such that the bent portions of the resilient plate are in contact with the recording sheet separator to close the paper passageway. The recording sheet passes through the paper passageway while being pressed gently by the bent portions against the recording sheet separator.

Incorporating the paper supply rollers into the paper cassette makes it unnecessary to provide roller openings that allows the paper supply rollers to enter the paper cassette, and thus provides improved light- and moisture-shielding properties. Where the paper supply rollers are not incorporated into the paper cassette, the sliding lid member is mounted to the roller opening, and is urged by a coiled spring to the closed position, so the roller opening is closed while the paper cassette is not attached to the printer. Thereby, the paper cassette is maintained light-tight and moisture-tight.

PREFERRED EMBODIMENTS OF THE INVENTION

For detailed description, the present invention will be described with reference to the accompanied drawings.

Figure 1:
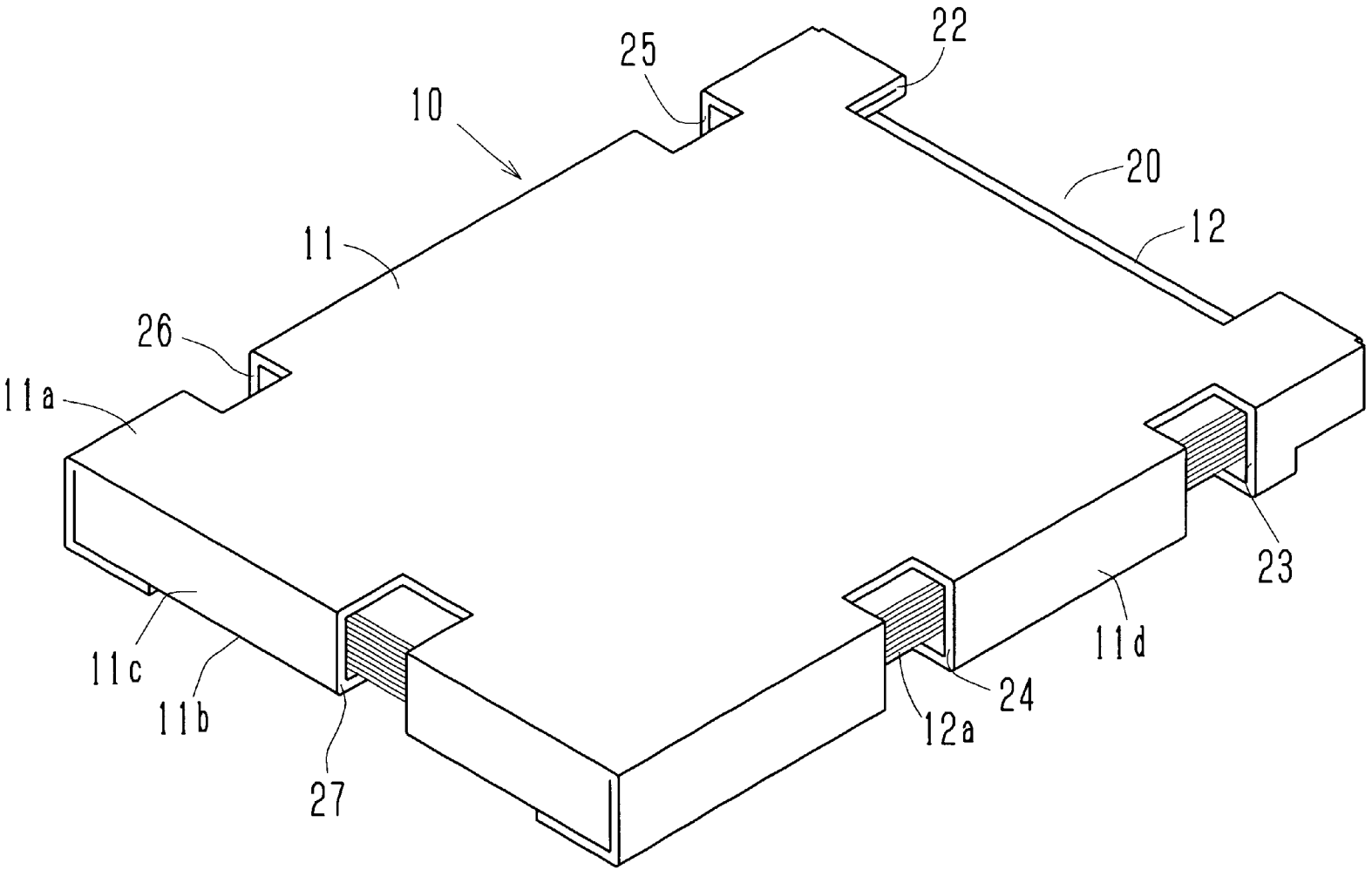
FIG. 1 is a perspective view of an appearance of a recording sheet package.
Figure 2:
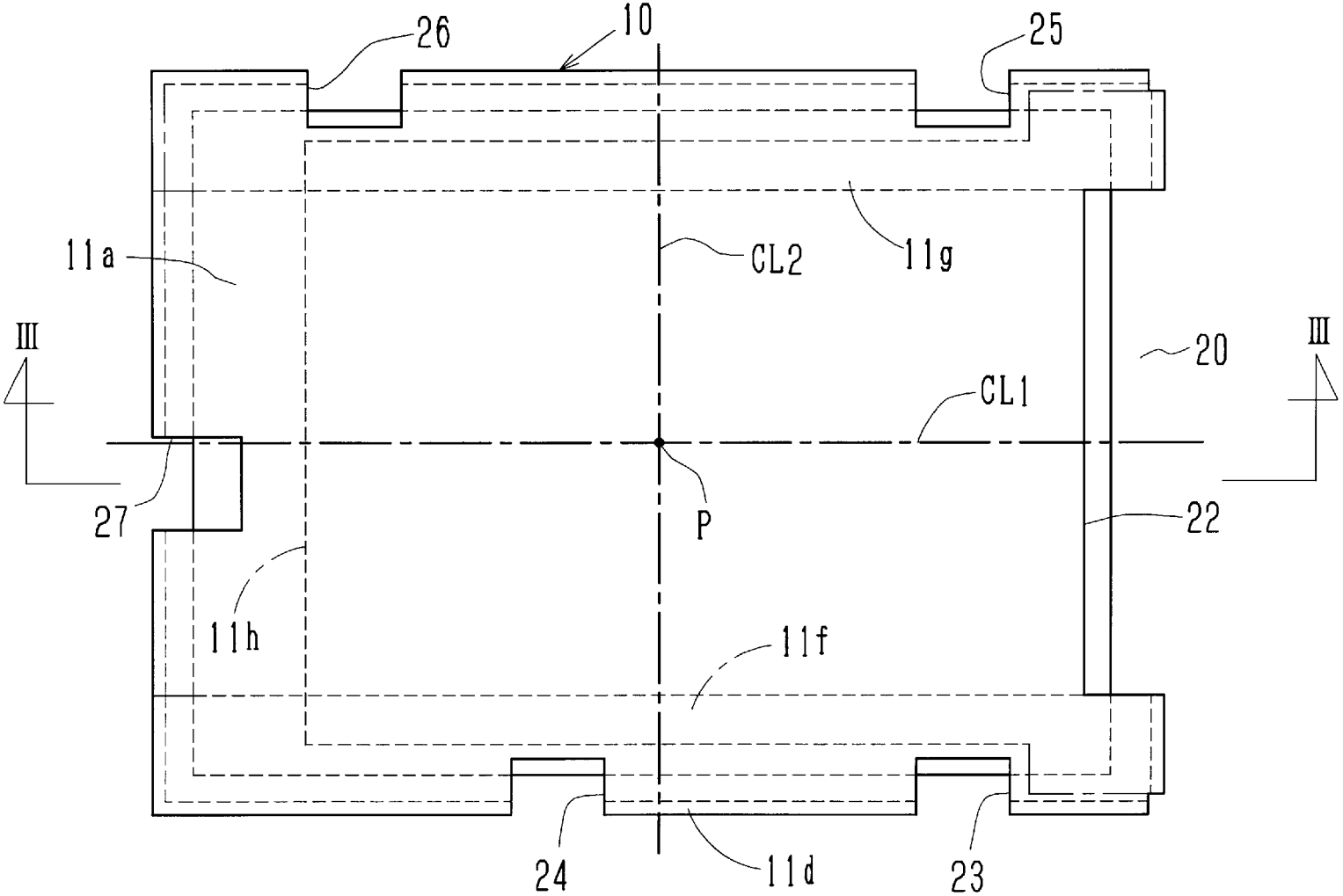
FIG. 2 is a top plan view illustrating the recording sheet package.
Figure 3:
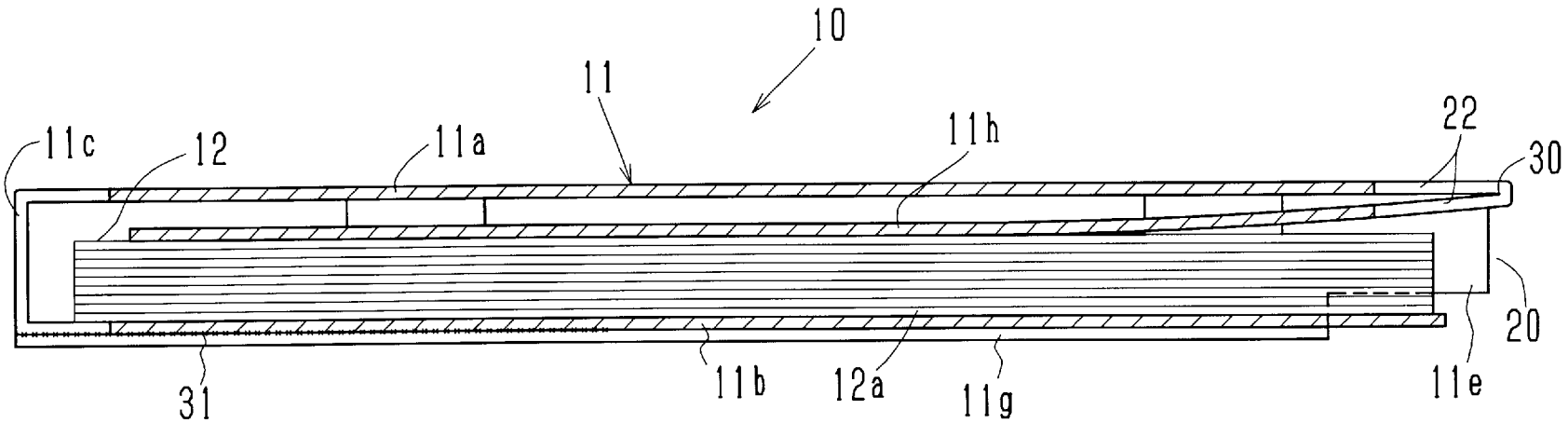
FIG. 3 is a sectional view taken along a line III—III of FIG. 2.

As shown in FIGS. 1 to 3, a recording sheet package 10 contains in a casing 11 twelve recording sheets 12 of thermosensitive type piled up in a stack with their base side upward and their thermosensitive coloring surfaces downward. However, as for recording sheets of a type that have an adhesive surface and a releasing paper for use as stickers and thus have a greater thickness, ten sheets are packed in a package. A protective sheet 12*a* is disposed under the bottom recording sheet 12, in tight contact with the thermosensitive recording surface of the recording sheet 12, so as to shield the thermosensitive recording surface from light and moisture. But the protective sheet 12*a* may be omitted.

Figure 4:
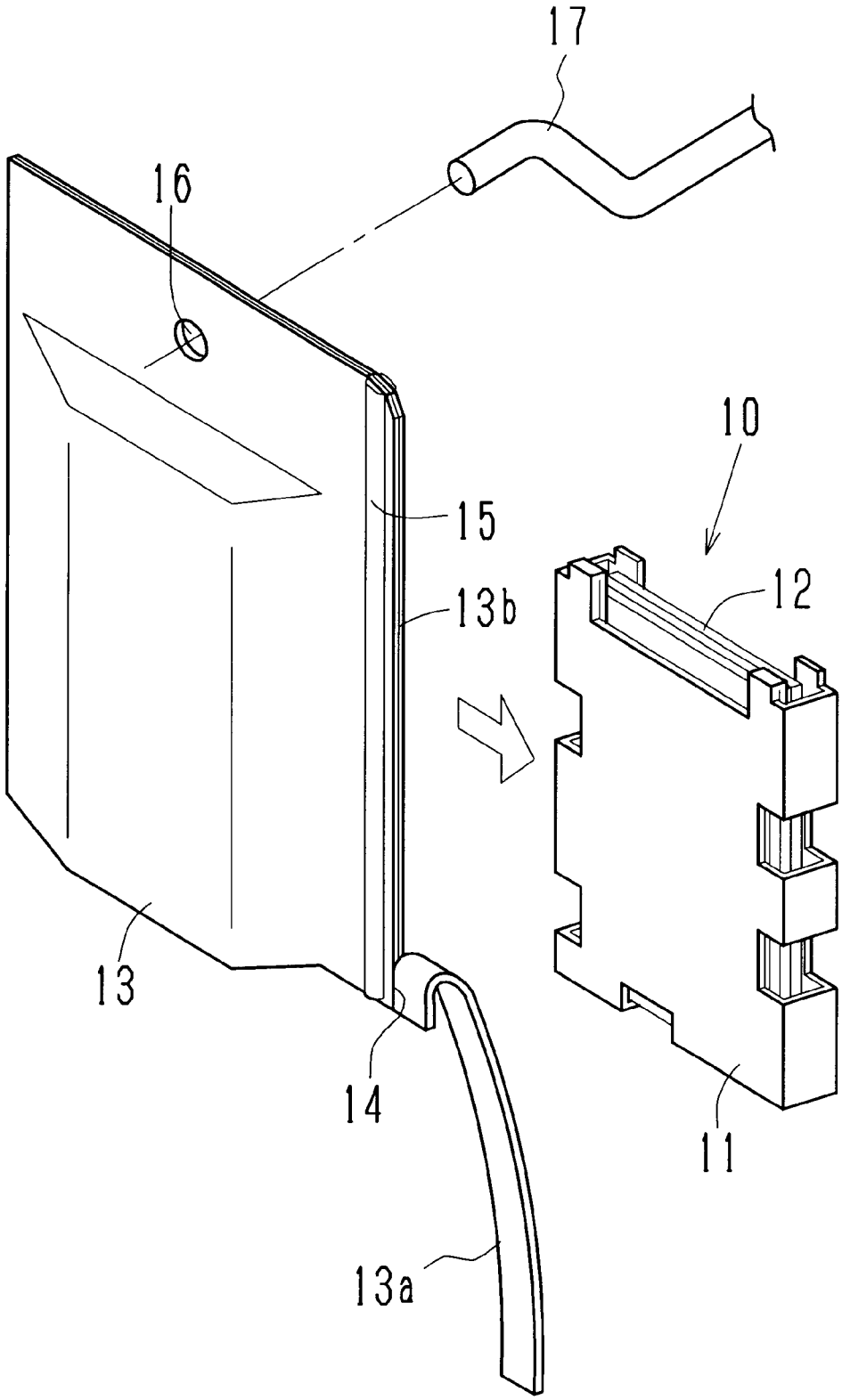
FIG. 4 is a perspective view illustrating the recording sheet package taken out from a bag.

As shown in FIG. 4, the recording sheet package 10 is enclosed in a light-tight and moisture resistant bag 13 in the stores. The bag 13 is opened by tearing off a margin 13*a* along a cutting line 14, to use the recording sheet package 10. The bag is provided with a plastic fastener 15 along an opening 13*b*, for permitting enclosing the recording sheet package 10 again after it is half-used. The fastener 15 consists of a pair of engaging ridges, of which male ridge is force-fitted in female ridge in a well-known manner to seal the bag. Designated by 16 is a hole through which the bag 13 may hang on a hook 17 for exhibition and sale.

Figure 5:
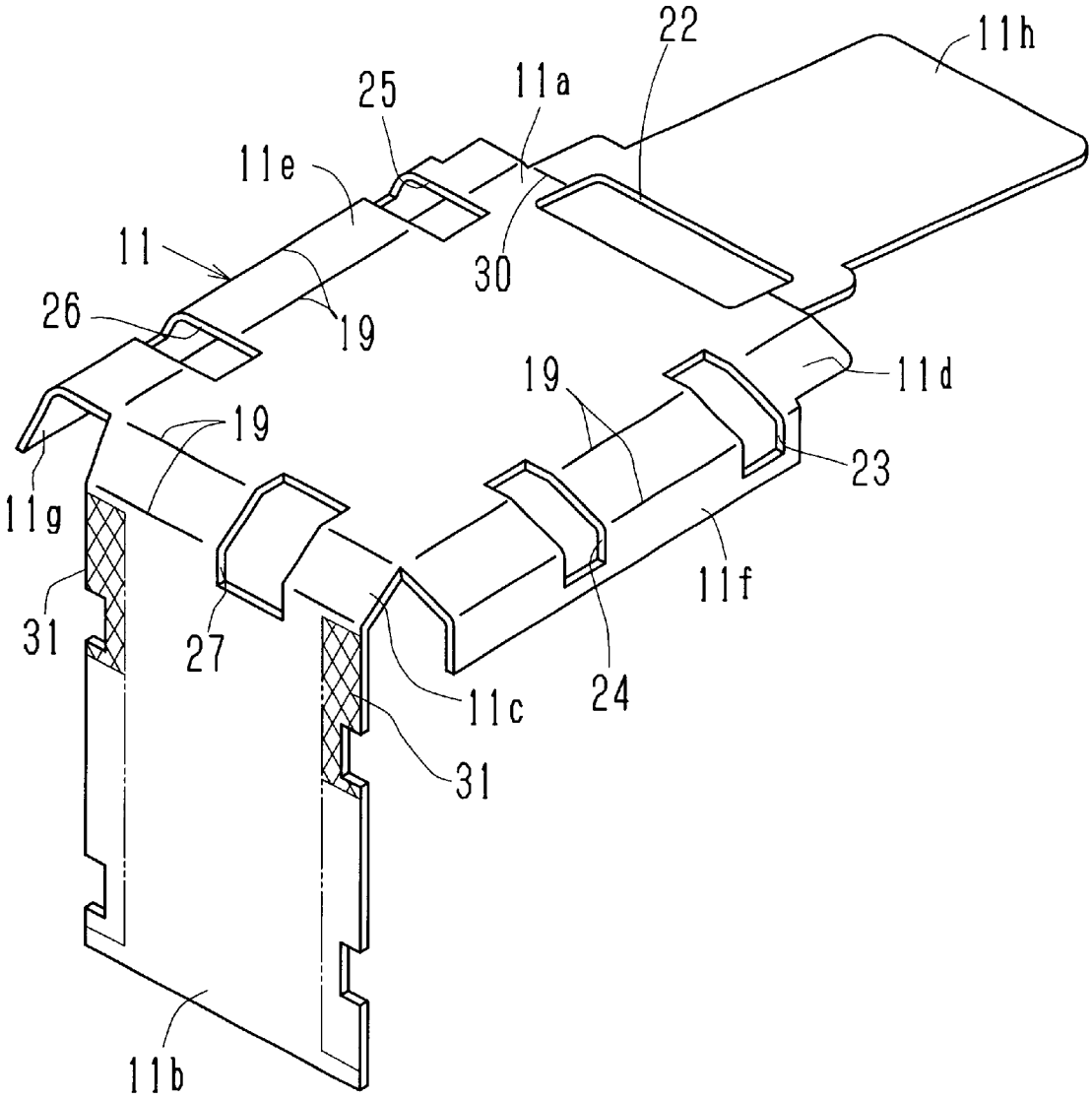
FIG. 5 is a perspective view illustrating an unfolded casing of the recording sheet package.

As shown in FIG. 5, the casing 11 is shaped into a thin parallelepiped contour by folding a blade along folding lines 19, the blade being formed by blanching a sheet of thick dust-proof paper made of long fibers. The dust-proof paper made of long fibers reduces generation of cutting dusts from the casing 11 at the blanching and at the paper feeding as well, and thus prevents bad influence of the cutting dust on the print. The casing 11 consists of rectangular top and bottom plates 11*a* and 11*b* that are slightly larger than the recording sheet 12, an end plate 11*c* connecting the top plate 11*a* to the bottom plate 11*b*, side plates 11*d* and 11*e* on opposite sides of the top plate 11*a*, and supporting plates 11*f* and 11*g* that are respectively connected to the side plates 11*d* and 11*e* through the folding lines 19. Another end of the casing 11 opposite to the end plate 11*c* is opened for use as a paper feed out opening 20. To a short side of the top plate 11*a* that extends by the paper feed out opening 20, a pressing plate 11*h* is connected through a folding line 30. Between the top plate 11*a* and the pressing plate 11*f*, there is formed a roller entrance 22 for paper supply rollers 21 (see FIG. 8) that are provided in a thermosensitive printer.

Cutouts 23, 24, 25, 26 and 27 are formed through the side plates 11*d* and 11*e* and the end plate 11*c*, each of which extends from the top plate 11*a* through one of the plates 11*c* to 11*e* to the bottom plate 11*b*. As shown in FIG. 2, the cutouts 23 and 25 are located symmetrically about a center line CL1 that extends in a paper supply direction of the recording sheet 12 across a center P of the casing 11. The cutout 24 is not symmetrical with the cutouts 25 and 26 about the center line CL1. The cutouts 23 and 24 are not symmetrical with each other about a center line CL2 that extends across the center P perpendicularly to the center line CL1.

As shown in FIG. 3, the pressing plate 11*h* is laid under the top plate 11*a* by folding at an angle of 180 degrees along the folding line 30. Thereby, the roller entrance 22 is connected to the paper feed out opening 20, and the pressing plate 11*h* urges the uppermost recording sheet 12 toward the bottom plate 11*b*, so the recording sheets 12 come into tight contact with each other. Accordingly, the thermosensitive recording surface is covered with the lower recording sheet 12, such that air and light hardly enter the thermosensitive recording surface. That is, the pressing plate 11*h* provides moisture- and light-shielding effects, and prevents the coloring characteristics from being affected by moisture and light.

On those portions where the supporting plates 11*f* and 11*g* meet the bottom plate 11*b*, along opposite end portions from the paper feed out opening 20, there are provided adhesive layers 31. The adhesive layers 31 keep the casing 11 in the parallelepiped shape. Because the adhesive layers 31 are not provided along the entire meeting zones between the bottom plate 11*b* and the supporting plates 11*f* and 11*g*, but only along the opposite end portions from the paper feed out opening 20, that is about one third to one half of the entire length (the long-side length) of the meeting zones, it is possible to push up almost a half of the bottom plate 11*b* on the paper feeding opening side, with decreasing number of the recording sheets 12, as set forth later.

Figure 6:
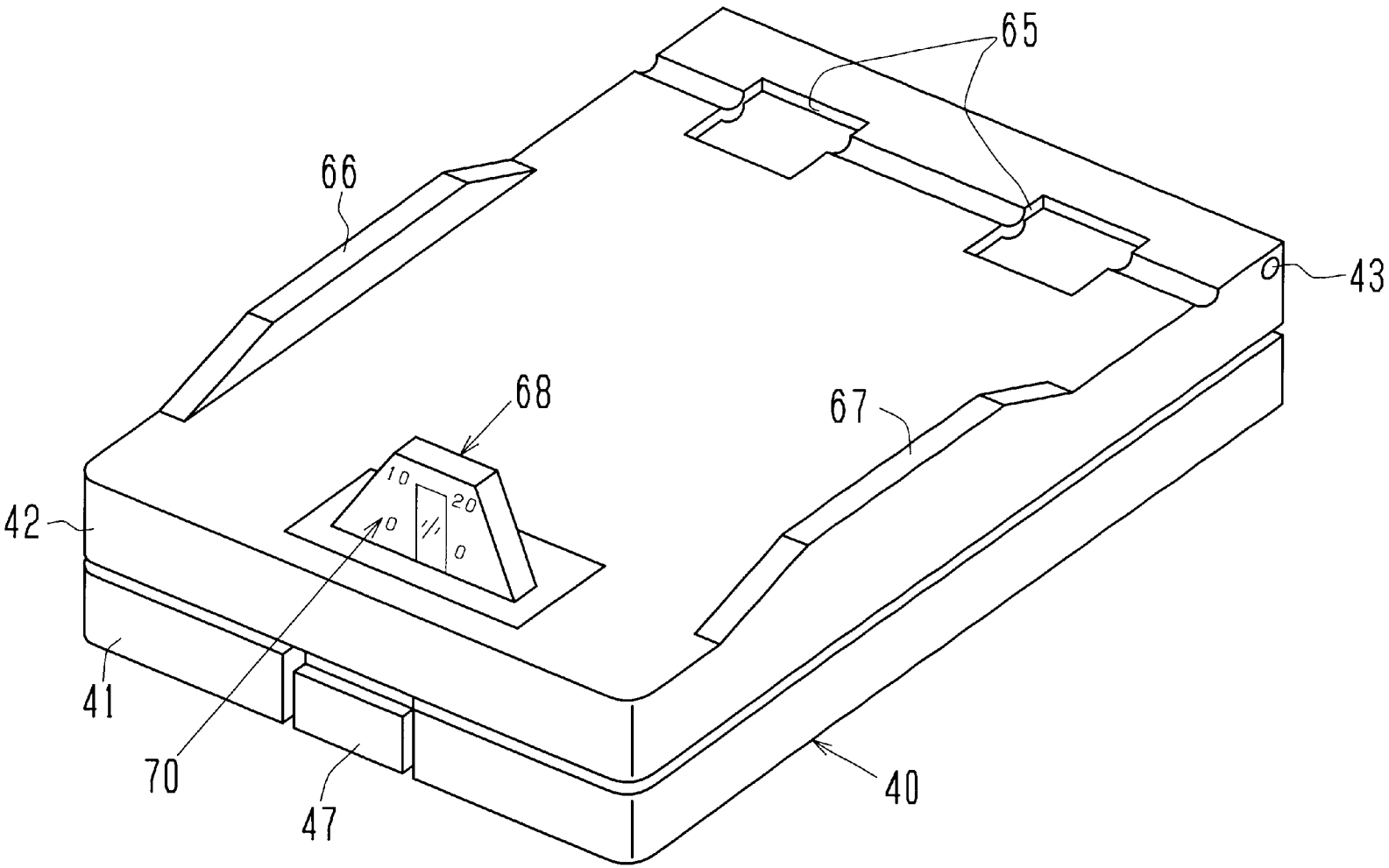
FIG. 6 is a perspective view illustrating a paper cassette.
Figure 7:
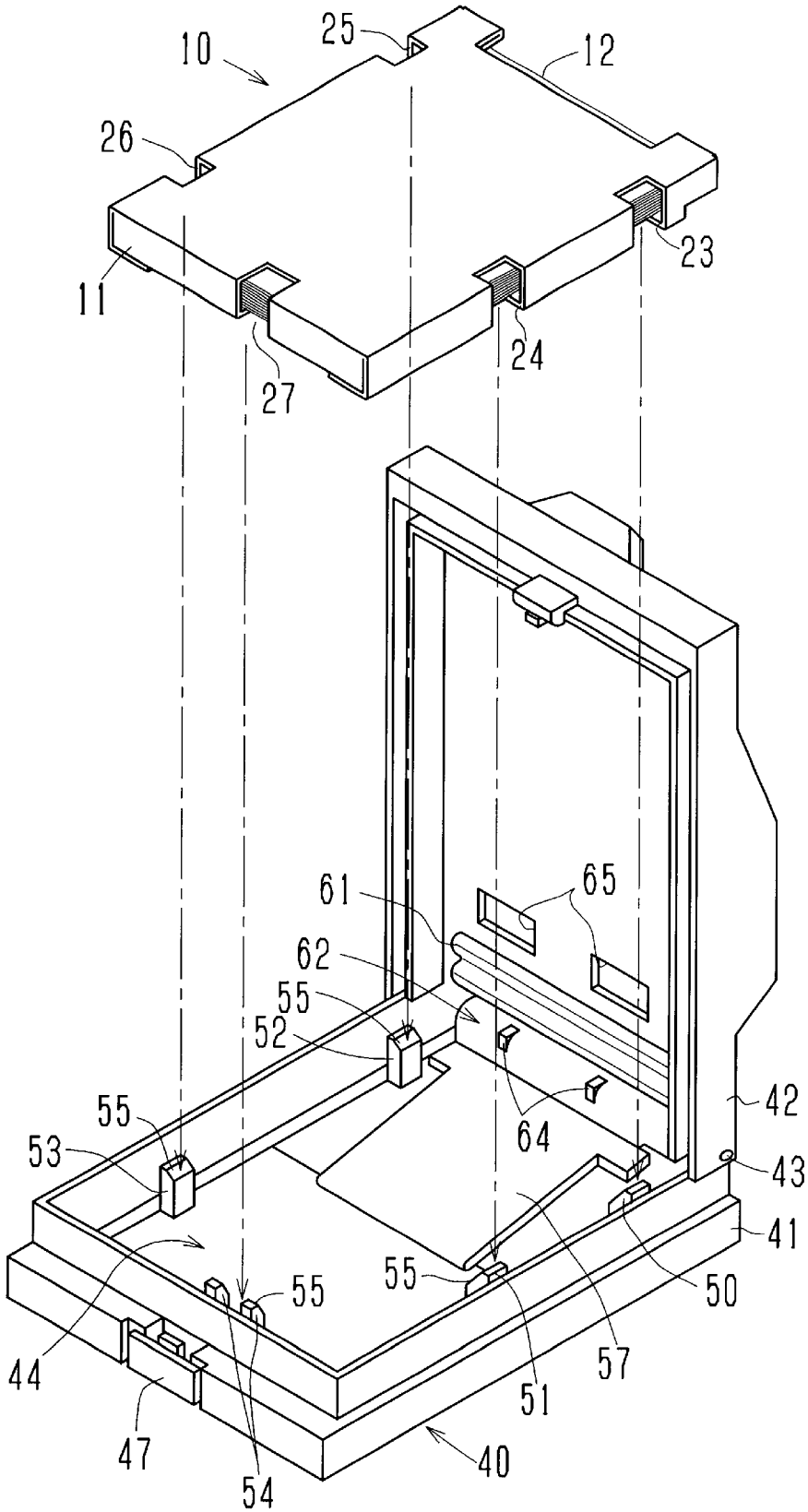
FIG. 7 is a perspective view illustrating the paper cassette with its lid open, and the recording sheet package.
Figure 8:
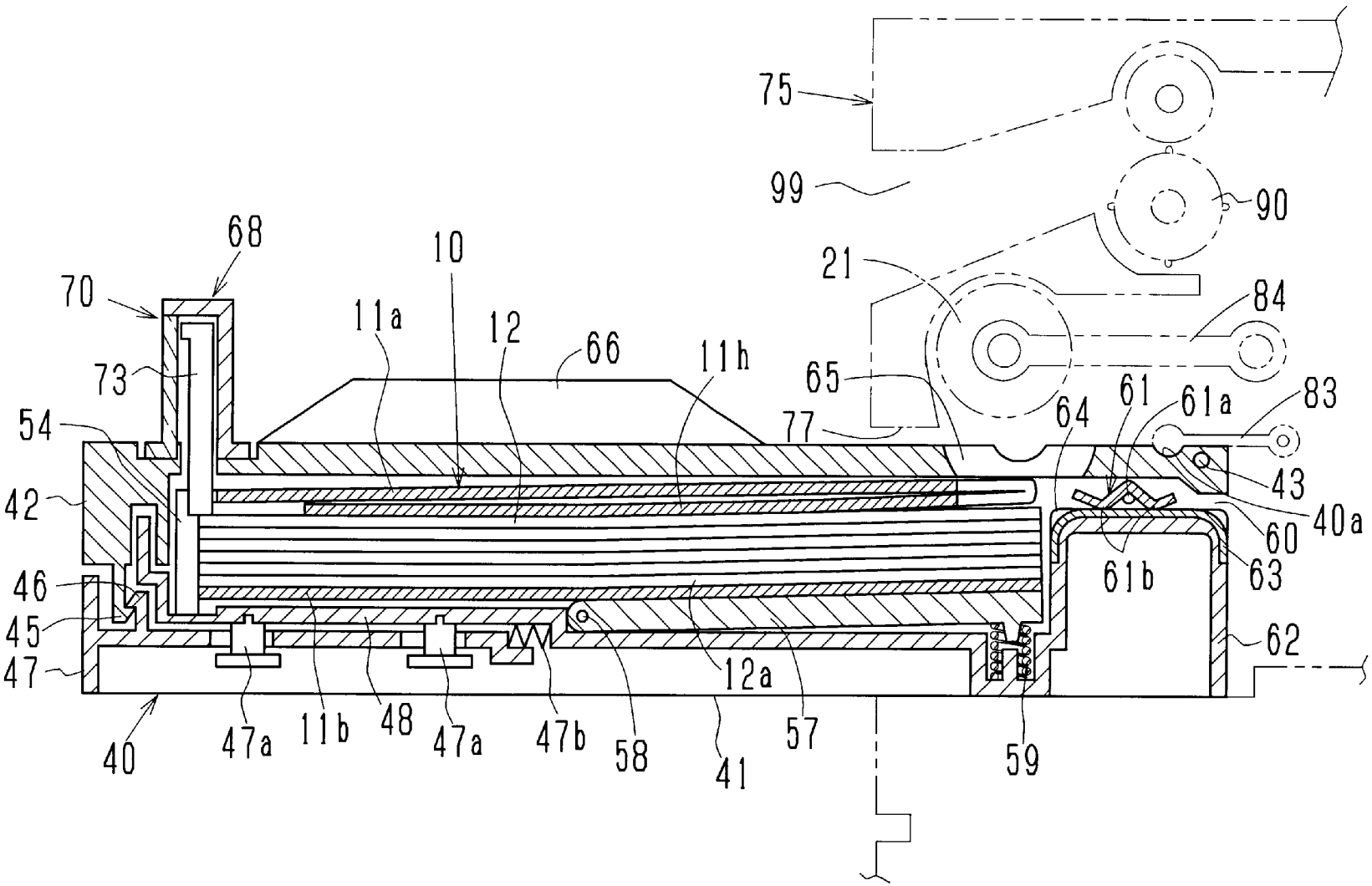
FIG. 8 is a sectional view illustrating an interior of the paper cassette containing the recording sheet package.

FIGS. 6 and 7 are perspective views of a paper cassette 40 for holding the recording sheet package 10. For accepting the recording sheet package 10, the paper cassette 40 consists of a cassette body 41 and a lid 42, and has a thin parallelepiped shape. The lid 42 is hinged to the cassette body 41 through a mounting shaft 43 such that the lid 42 may be opened at an angle of 90 degrees. While the lid 42 is open and erect, the recording sheet package 10 is loaded in a package loading section 44. When the lid 42 is closed into a horizontal position, as shown in FIG. 8, engaging claws 45 and 46 are engaged with each other, so the lid 42 is maintained in this closed position. To open the lid 42, a disengaging blade 47 is pushed to disengage the engaging claws 45 and 46, allowing the lid 42 to open. The disengaging plate 47 is coupled to a bottom plate 48 through mounting shafts 47*a*, such that the disengaging plate 47 is movable in the paper supply direction of the recording sheets 12, and is urged by a coiled spring 47*b* to engage the engaging claw 46 with the engaging claw 45.

As shown in FIG. 7, the package loading section 44 is made slightly larger than the recording sheet package 10, so as to facilitate loading. On the bottom plate 48 of the loading section 44, guide protrusions 50, 51, 52, 53 and 54 are formed in those locations corresponding to the cutouts 23 to 27. The guide protrusions 50 to 54 are rectangular, and have an inclined guide surface 55 formed on their top faces. Through these guide surfaces 55, the guide protrusions 50 to 54 are smoothly guided into the cutouts 23 to 27.

When the recording sheet package 10 is placed properly in the loading section 44, the guide protrusions 50 to 54 are inserted into the cutouts 23 to 27, allowing loading the recording sheet package 10. When the recording sheet package 10 is placed in the loading section 44 in a left-side-right posture or an inverted posture, the cutouts 23 to 27 do not fit in the guide protrusions 50 to 54, so the recording sheet package 10 cannot be inserted, showing that the loading posture is wrong. In that case, the recording sheet package 10 is turned around to position the cutouts 23 to 27 in correspondence with the guide protrusions 50 to 54, so the recording sheet package 10 may be reloaded correctly in the loading section 44.

Figure 10:
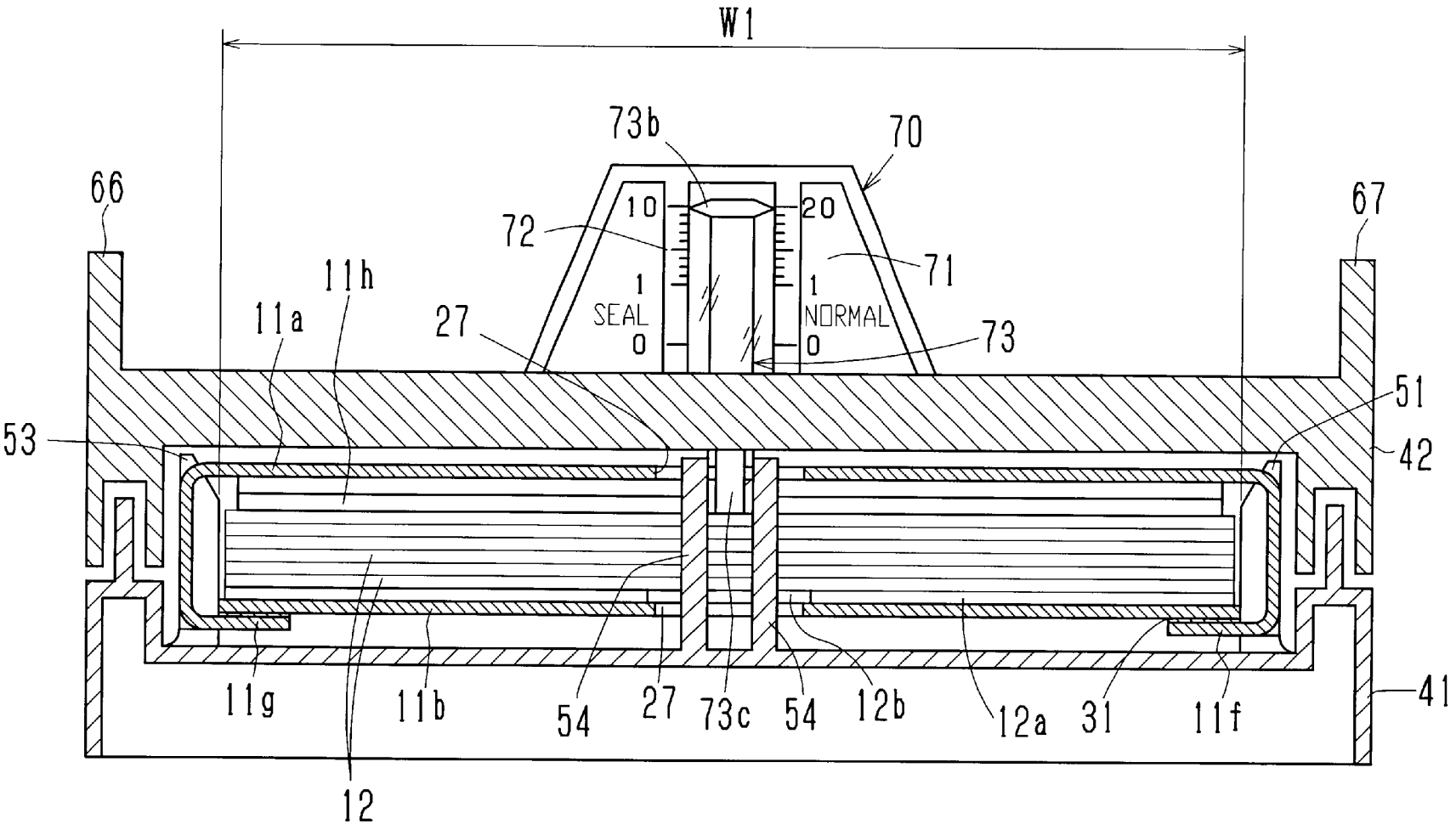
FIG. 10 is a sectional view illustrating a paper remainder indicator of the paper cassette.

Among of the guide protrusions 50 to 54, two disposed on the left side constitute a pair, and two disposed on the right side constitute another pair. As shown in FIG. 10, a distance W1 from inner sides of one pair of the guide protrusions 50 and 52 to inner sides of the other pair of the guide protrusions 51 and 53 is slightly greater than the width of the recording sheet, so the recording sheets 12 are inserted in between these two pairs of the guide protrusions, and thereby aligned in the lateral direction (the direction perpendicular to the paper supply direction) inside the casing 11. Therefore, even if the recording sheets 12 are loosely held in the casing 11, the recording sheets 12 are automatically positioned in the perpendicular direction to the paper supply direction by the guide protrusions 50, 51, 52 and 53, when the recording sheet package 10 is loaded in the paper cassette 40. Accordingly, the recording sheet 12 would not be fed aslant, so that the image would not be recorded obliquely, or the recording sheet 12 would not get jammed. Designated by 12*b* is a cutout of the protective sheet 12*a*.

As shown in FIG. 8, the guide protrusions 54 position the recording sheets 12 in the paper supply direction within the casing 11. Therefore, even if the recording sheets 12 are loosely held in the casing 11, the recording sheets 12 are automatically positioned in the paper supply direction by loading the recording sheet package 10 in the paper cassette 40. A push-up plate 57 is provided on a portion of the bottom plate 48 of the package loading section 44, and is coupled to the bottom plate 48 pivotally through a mounting shaft 58. The push-up plate 57 is urged by a coiled spring 59 to move upward, so as to push up the bottom plate 11*b* of the casing 11 of the recording sheet package 10.

A gap is formed between the cassette body 41 and the lid 42 in the vicinity of the mounting shaft 43, to provide a paper passageway 60. A recording sheet separator 62 is protruded into the paper passageway 60, and a cork member 63 is cemented to a surface of the recording sheet separator 62. A recording sheet pressing blade 61 is also provided in the paper passageway 60, that is mounted to the lid 42 through a mounting shaft 61*a*. The recording sheet pressing blade 61 is formed by bending a leaf spring into a wavy shape, so bent portions 61*b* gently press the recording sheet 12 against the recording sheet separator 62. Because of the cork member 63 and the recording sheet pressing blade 61, if two or more of the recording sheets 12 are about to be fed out together, the lower recording sheet 12 is stopped by friction against the cork member 63, so the upper recording sheet 12 alone is fed out. Although the cork member 63 covers substantially the whole surface of the upper portion of the recording sheet separator 62, the cork member 63 may be provided only in a central portion that comes into contact with the recording sheet. The recording sheet separator 62 further has a pair of separating projections 64 for securer prevention against multi-feeding. The separating projections 64 are designed to confront leading ends of the lower ones of those recording sheets which are being fed together, and thus stop them from advancing.

The bent portions 61*b* are provided before and behind the mounting shaft 61*a* in the paper supply direction. Because the bent portions 61*b* are resiliently brought into contact with the recording sheet separator 62, the paper passageway 60 is tightly closed. This blocks entrance of dusts or the like, and also increases light-tightness and moisture-tightness. Moreover, because the bent portions 61*b* close the passageway at two points, at least one of the bent portions 61*b* closes the passageway even while the leading end of the recording sheet passes through.

Figure 9:
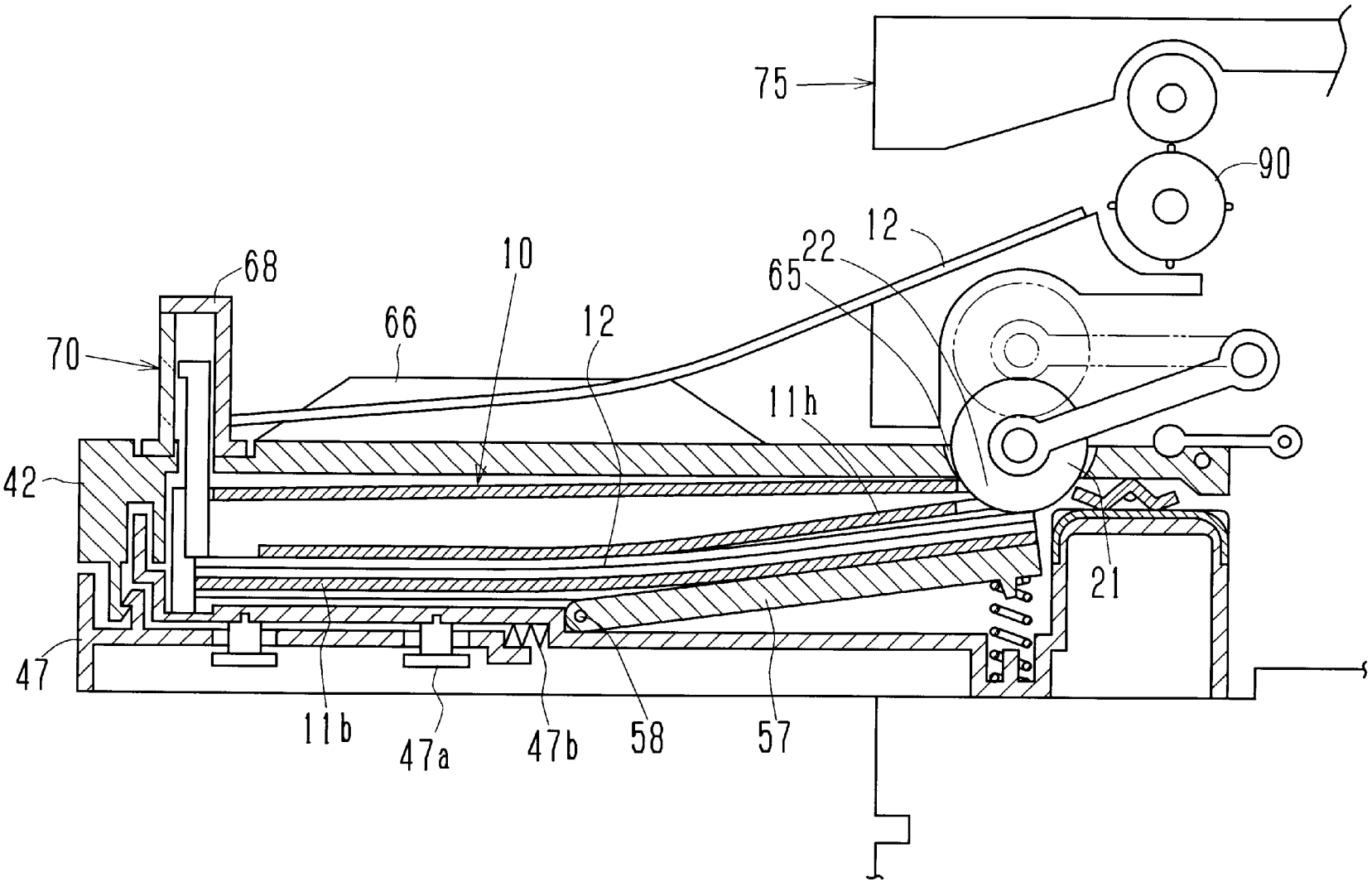
FIG. 9 is a sectional view illustrating the interior of the paper cassette in which a few of the recording sheets remain.

As shown in FIG. 9, roller openings 65 are formed through the lid 42 of the paper cassette 40 in positions corresponding to the roller entrance 22 of the recording sheet package 10. Into these roller openings 65 are inserted paper supply rollers 21 when the paper cassette 40 is set in a thermosensitive printer 75. Then, through the roller entrance 22, the paper supply rollers 21 come to contact with the uppermost one of the recording sheets 12 in the recording sheet package 10. The paper supply rollers 21 rotate in a paper supply direction at the start of printing, to withdraw the uppermost recording sheet 12 from the recording sheet package 10, and supply it to a print stage 74 (see FIG. 11) of the thermosensitive printer 75.

As shown in FIGS. 6 and 9, a top side of the lid 42 doubles as a paper ejection tray, so paper guides 66 and 67 and a stopper 68 are protruded from the lid 42. The paper guides 66 and 67 are for guiding the recording sheet 12 at its lateral sides, and are formed along the length of the lid 42. The stopper 68 is for stopping the recording sheet 12 from slipping off the lid 42.

On an opposite side of the stopper 68 from the paper passageway 60, there is provided a paper remainder counter 70. As shown in FIG. 10, the paper remainder counter 70 has an indicator 73 whose pointer 73*a* indicates a remainder (the number of remaining ones) of the recording sheets 12 on scales 71 and 72. The scales 71 and 72 are disposed on opposite lateral sides of the indicator 73, wherein the right scale 71 is for ordinary sheets and has graduations ranging from "20" to "zero". The left scale 72 is for thicker recording sheets, including the recording sheets for stickers, and has graduations ranging from "10" to "zero". A lower end 73*c* of the indicator 73 is contacted with the uppermost one of the recording sheets 12.

Figure 12:
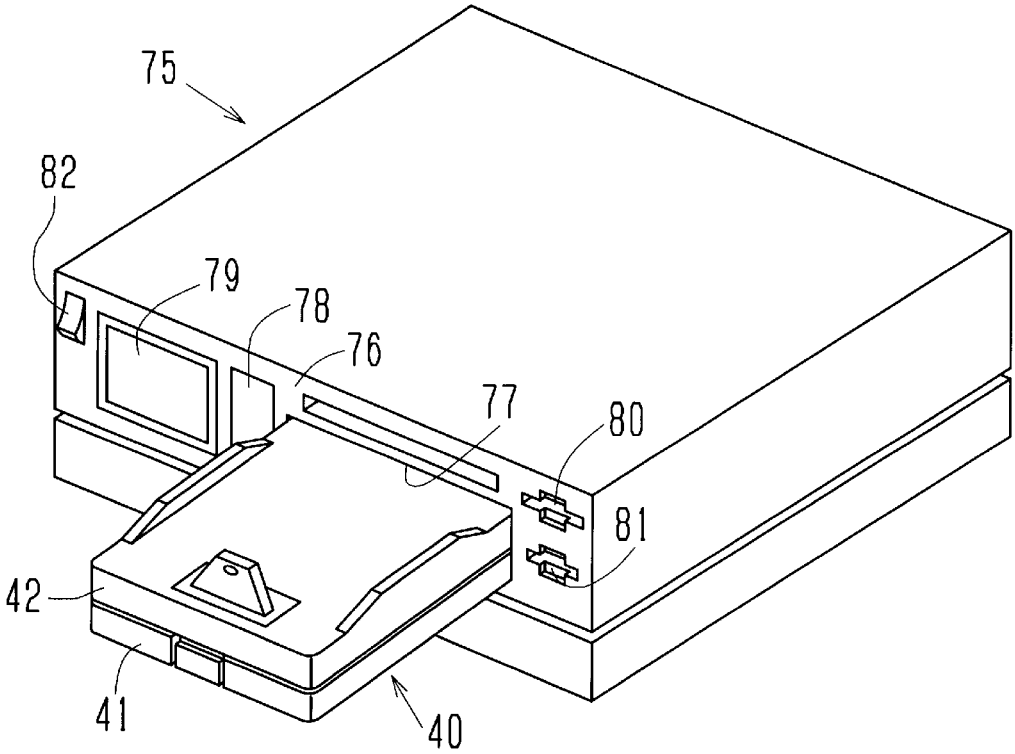
FIG. 12 is a perspective view illustrating an overall appearance of the thermosensitive printer of FIG. 11, with the paper cassette attached thereto.

FIG. 12 is a perspective view showing the thermosensitive printer 75 loaded with the paper cassette 40. The thermosensitive printer 75 has an inlet 77 on its front face 76, into which the paper cassette 40 is inserted. When the paper cassette 40 is put in the inlet 77, a click engagement member 83 is engaged in a recess 40*a* of the paper cassette 40, as shown in FIG. 8, preventing the paper cassette 40 from dropping. Besides the inlet 77, there are provided an operation panel 78, an LCD 79, an IC card slot 80, a slot 81 for a smart media, and a power switch 82.

Figure 11:
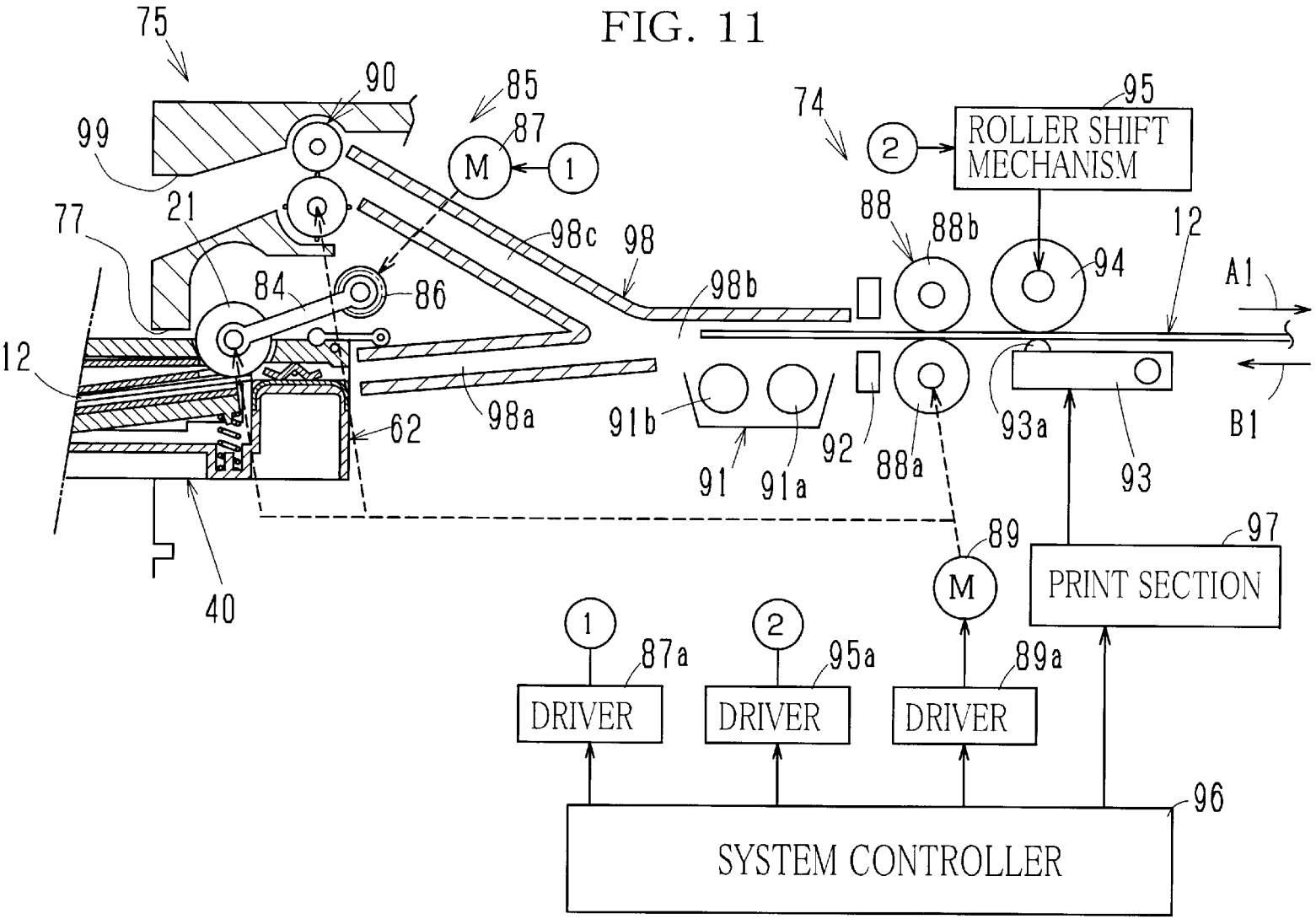
FIG. 11 is a schematic diagram illustrating essential parts of a thermosensitive printer according to a first embodiment of the present invention.

As shown in FIG. 11, the paper supply rollers 21 are each pivoted on a roller holding arm 84. The roller holding arms 84 are moved through an arm shifting mechanism 85 between a paper feeding position where the paper supply rollers 21 are in contact with the uppermost one of the recording sheets 12, and a retracted position retracted upward from the paper feeding position, as shown in FIG. 8. In the paper feeding position, as shown in FIG. 9, the paper supply rollers 21 are inserted in the openings 65 of the lid 42. Since the recording sheets 12 are pushed upward by the push-up plate 57 inside the paper cassette 40, the uppermost one of the recording sheets 12 is kept in contact with the paper supply rollers 21.

The arm shifting mechanism 85 is constituted of a gear 86 secured to the roller holding arm 84, and a motor 87 for rotating the gear 86 bi-directionally. But it is possible to use a cam mechanism or a link mechanism instead of the gear 86 in the arm shifting mechanism 85. It is also possible to use a solenoid or the like instead of the motor 87.

The paper supply rollers 21 are interconnected with a capstan roller 88*a* of a pair of feed rollers 88*a* and 88*b* through a not-shown timing belt. The capstan roller 88*a* is rotated by a pulse motor 89. The feed roller pair 88*a* and 88*b* consists of the capstan roller 88*a* and a nip roller 88*b*. The driving power of the pulse motor 89 is also transmitted to a pair of ejection rollers 90 through the timing belt. The paper supply rollers 21, the feed rollers 88*a* and 88*b* and the ejection rollers 90 are designed to have the same peripheral speed.

The feed rollers 88*a* and 88*b* feed the recording sheet 12 in the paper supply direction shown by an arrow A1 upon forward rotation of the pulse motor 89, and feed the recording sheet 12 in a printing direction shown by an arrow B1 upon reverse rotation of the pulse motor 89. On an upstream side of the feed rollers 88*a* and 88*b* in the paper supply direction A1, there are disposed a fixing device 91 and a paper sensor 92 in this order from the upstream side. On a downstream side of the feed rollers 88*a* and 88*b* in the paper supply direction A1 are disposed a thermal head 93 and a platen roller 94. The platen roller 94 is moved by a roller shift mechanism 95 between a recording position for pressing the recording sheet 12 onto a heating element array 93*a* of the thermal head 93, and a retracted position away from the heating element array 93*a*.

The respective motors 87 and 89 and the roller shift mechanism 95 are controlled by a system controller 96 through drivers 87*a*, 89*a* and 95*a*. The heating elements of the thermal head 93 are controlled to heat in accordance with image data through a print section 97 and a head driver that is not shown but incorporated into the thermal head 93. The system controller 96 is constituted of a well-known microcomputer, and controls the respective elements so as to record a full-color image on the recording sheet 12 in a three-color frame sequential fashion. The recording sheet 12 supplied through a paper supply path 98*a* of a paper guide 98 is fed to the printing stage 74 through a printing path 98*b*. In the three-color frame sequential printing, the feed rollers 88*a* and 88*b* convey the recording sheet 12 back and forth along the printing path 98*b* and a paper ejection path 98*c*. At the conclusion of printing, the recording sheet 12 is ejected by the ejection rollers 90 through the paper ejection path 98*c* out of an outlet 99 onto the top side of the paper cassette 40.

Figure 13:
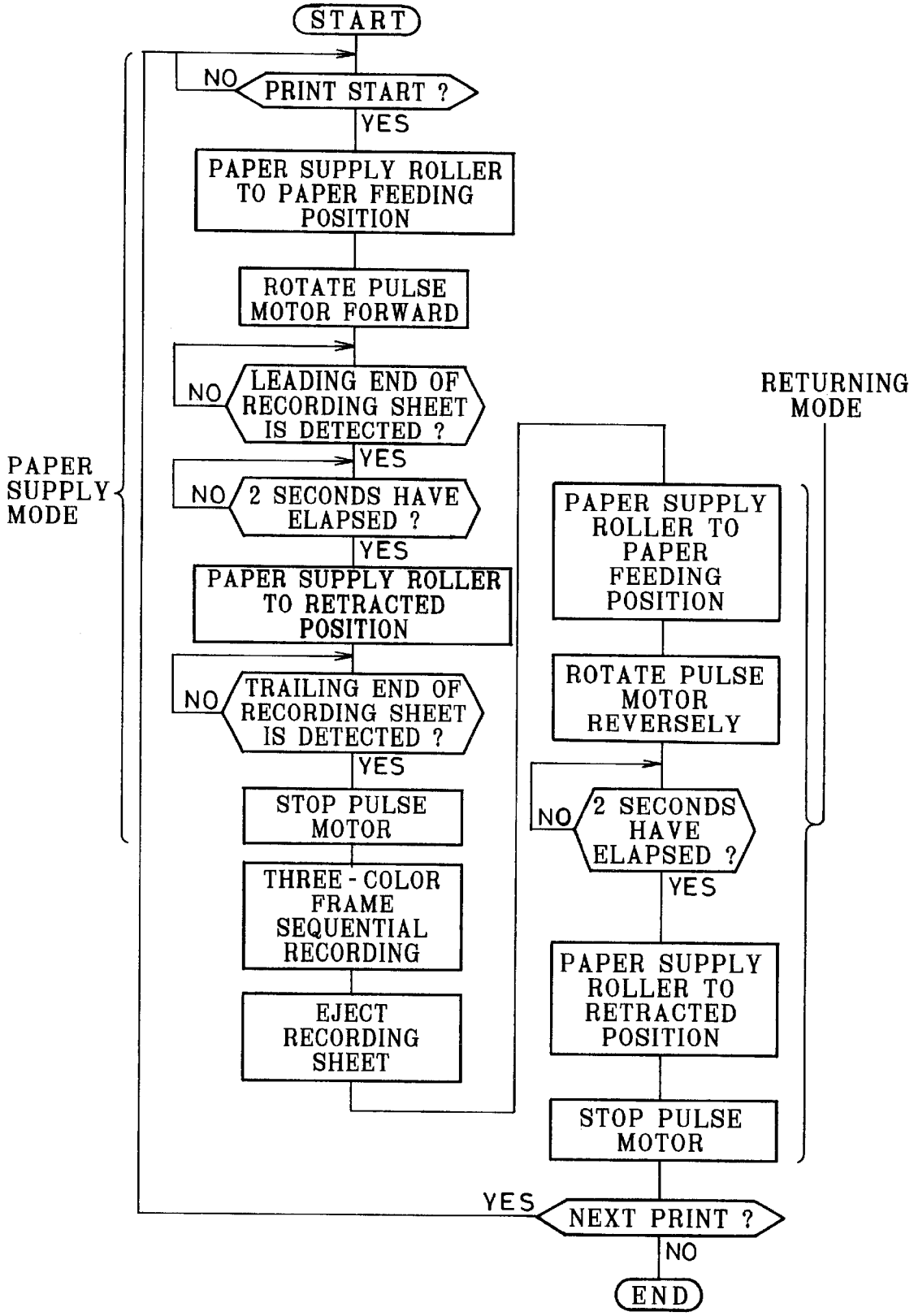
FIG. 13 is a flow chart illustrating an operation of the thermosensitive printer of FIG. 11.

Now the operation of the printer having the above described configurations will be described with reference to FIG. 13.

A printing operation is designated by an operation on the operation panel 78, the LCD 79 displays an image to print. After checking the displayed image, a print key on the operation panel 78 is operated to start printing. On printing, first the arm shifting mechanism 85 sets the paper supply rollers 21 to the paper feeding position. Thereafter, the pulse motor 89 rotates forward to rotate the paper supply roller 21 in the paper supplying direction. Upon this rotation of the paper supply rollers 21, the uppermost recording sheet 12 as being in contact with the rollers 21 is fed out from the paper cassette 40 to the printing stage 74. In two seconds after a leading end of the recording sheet 12 is detected by the paper sensor 92, the paper supply rollers 21 are retracted from the paper supply position to the retracted position, assuming that the leading end of the recording sheet 12 reaches the feed rollers 88*a* and 88*b* at that timing. Thereafter, the recording sheet 12 is conveyed in the paper supply direction A1 by the paper feed rollers 88*a* and 88*b*. When a trailing end of the recording sheet 12 moves past the paper sensor 92, a trailing end passage signal causes the pulse motor 89 to stop the forward rotation, and the recording sheet 12 stops at a print start position.

Thereafter, the pulse motor 89 is reversely rotated to convey the recording sheet 12 in the printing direction B1. While being conveyed, the recording sheet 12 first has a yellow image recorded thermally in its recording area. During the yellow recording, a yellow fixing lamp 91*a* of the fixing device 91 is turned on to fix a yellow thermosensitive coloring layer. After the yellow image printing is accomplished, the pulse motor 89 rotates forward to move the recording sheet 12 back to the print start position through the feed rollers 88*a* and 88*b*. Thereafter a magenta image is thermally recorded in the recording area in the same way, and a magenta fixing lamp 91*b* is turned on to fix the magenta thermosensitive coloring layer during this thermal recording. After the magenta recording, the recording sheet 12 is returned to the print start position in the same way. Thereafter, a cyan image is thermally recorded in the recording area. During this thermal recording, the magenta fixing lamp 91*b* is turned on to bleach those areas having no image recorded thereon. After the cyan image is thermal recorded, the recording sheet 12 is ejected onto the top side of the paper cassette 40 through the ejection rollers 90.

If the supply rollers 21 feed out not only the uppermost recording sheet 12 but also the second recording sheet 12 for some reasons, the lower recording sheet is caught on the recording sheet separator 62 by friction, and is stopped from moving out, so the upper recording sheet 12 alone is fed out. In that case, the lower recording sheet 12 stops in a half-drawn position. If the recording sheet 12 is left in this position, the leading end drawn out from the recording sheet package 10 does not get the moisture- and light-shielding effect that is provided by the tight contact between the neatly piled recording sheets 12. So the leading end is affected by moisture and light to change its coloring properties. This results in unexpected density variations or color variations in the leading end.

To avoid this problem, according to the present invention, a returning mode is executed, where the supply rollers 21 are rotated reversely to the paper supply direction for a constant time, e.g. for two seconds. In the embodiment shown in FIG. 13, the returning mode is executed after the conclusion of printing on one recording sheet 12. In this way, even if the following recording sheets 12 are partly drawn out along with the uppermost one, these sheets are fed back into the casing 11 without fail. Therefore, the entire surfaces of the recording sheets 12 are brought into tight contact with each other, and thus prevented from having their coloring properties affected by moisture and light. When the same image is to be printed on a plurality of recording sheets, the same processes, i.e., a paper supply mode and the three-color frame sequential recording and then the returning mode, are sequentially performed after the preceding recording sheet 12 is ejected.

Figure 14:
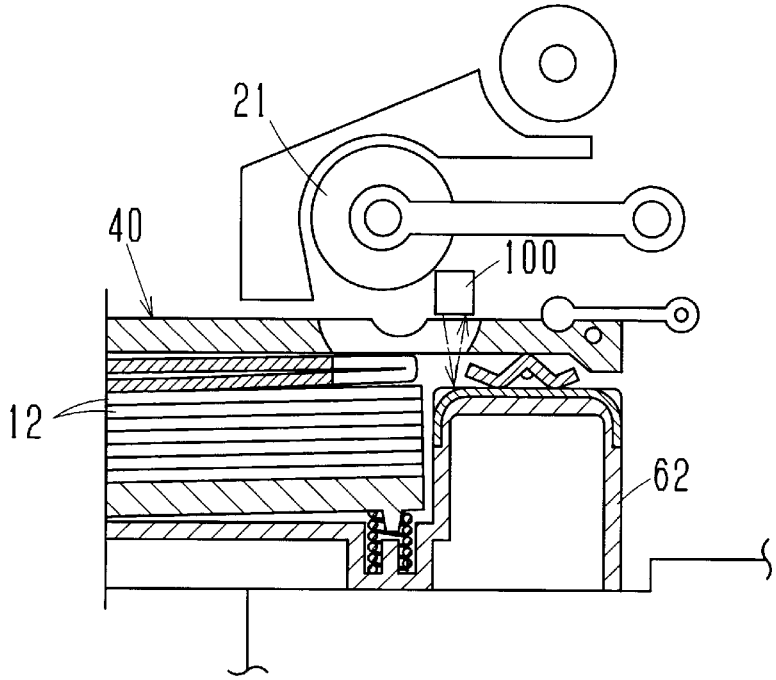
FIG. 14 is a schematic diagram illustrating essential parts of a thermosensitive printer with a paper sensor, according to a second embodiment of the present invention.

In the above embodiment, the paper supply rollers 21 are rotated reversely for the constant time to feed the recording sheets 12 back into the package 10 even when the multi-feeding of the recording sheets 12 does not occur. However, as shown in FIG. 14, it is alternatively possible to provide a paper sensor 100 beside the recording sheet separator 62, for detecting leading ends of the multi-fed recording sheets 12, so as to rotate the paper supply rollers 21 reversely to the paper supply direction only when the paper sensor 100 detects the leading ends of the recording sheets 12, thereby to feed the recording sheets 12 back into the package 10. The paper sensor 100 may be of an interruption-type that detects the recording sheet 12 as the recording sheet 12 interrupts an optical path, or a reflection-type that detects the recording sheet 12 based on a change in light amount. It is to be noted that those elements which are equivalent to the above embodiment are designated by the same reference numbers. According to this configuration, the recording sheet protruded from a paper supply start position in the paper cassette is returned to the paper supply start position, reducing unexpected density- and color-variations. This configuration is more efficient, because the paper supply rollers are rotated reversely to the paper supply direction only when the recording sheet is partly drawn out.

Figure 15:
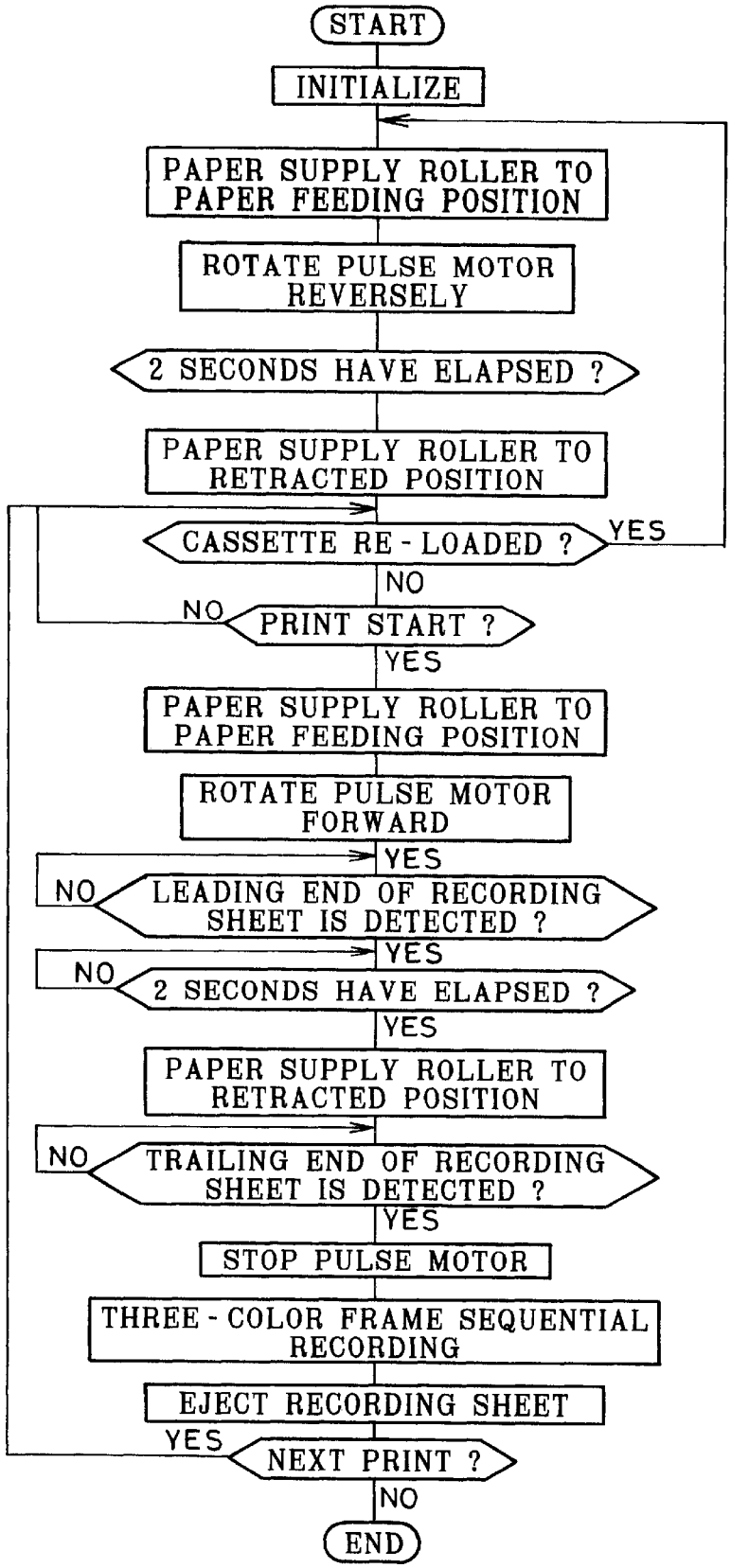
FIG. 15 is a flow chart illustrating an operation of a thermosensitive printer according a third embodiment of the present invention, wherein a returning mode for resetting the recording paper to a predetermined paper supply start position is carried out immediately after the printer is powered as well as immediately after the cassette is attached again.
Figure 16:
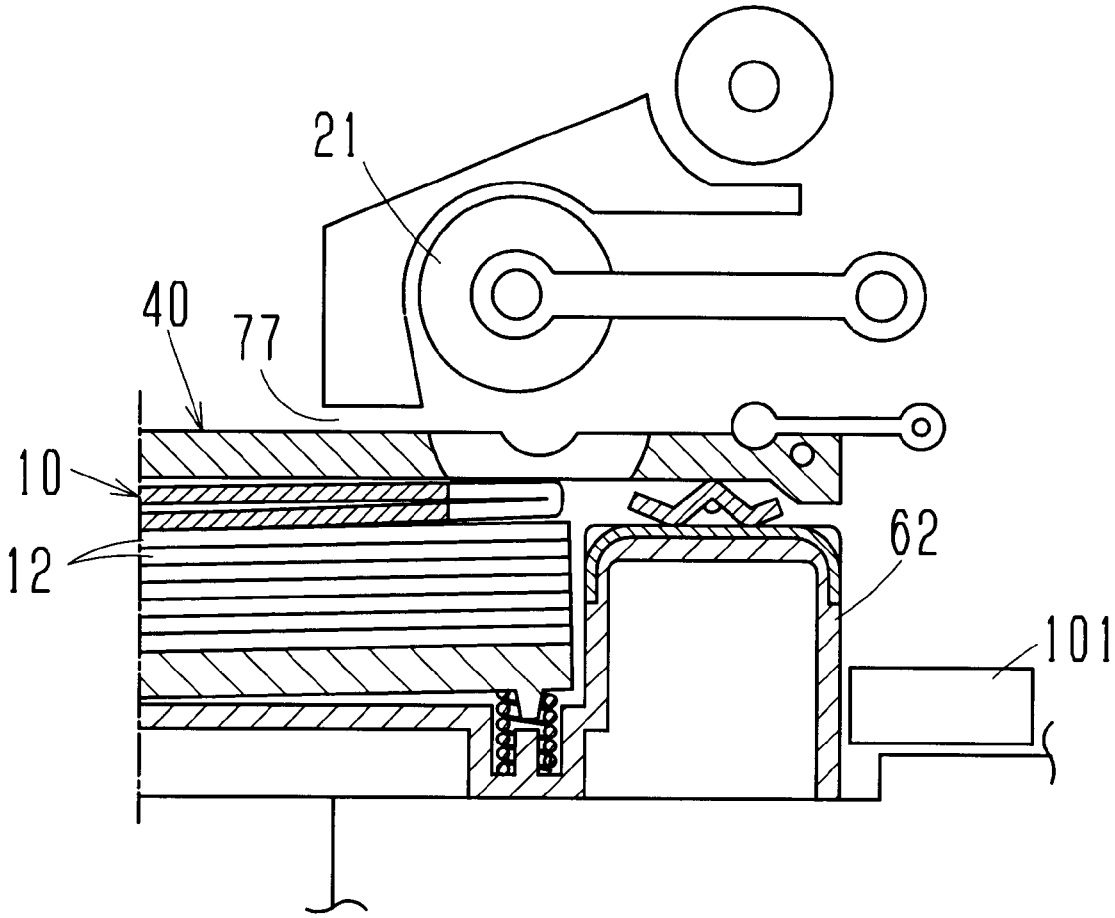
FIG. 16 is a schematic diagram illustrating essential parts of a thermosensitive printer with a cassette sensor, according to a fourth embodiment of the present invention.

FIG. 15 shows a flow chart of another embodiment, wherein the paper supply roller 21 are rotated reversely in a returning mode when a power source is turned on, and at each reloading of the paper cassette 40 after the start of power supply, for feeding the protruded recording sheets 12 from the paper supply start position back into the recording sheet package 10. In this embodiment, when the thermosensitive printer is powered, its respective elements are initialized to be set in their initial position and, thereafter, the paper supply rollers are moved down and rotated reversely for two seconds. Thereby, those recording sheets, which are protruded from the recording sheet package for some reasons, are returned to the paper supply start position. Since the recording sheet does not start being supplied in the protruded position, multi-feeding and paper-jamming are prevented.

In order to start the returning mode at the reloading of the paper cassette 40, a cassette sensor 101 is provided in the inlet 77 for the paper cassette 40, so the cassette sensor 101 detects if the paper cassette 40 is loaded or not. The cassette sensor 101 may be a limit switch that is turned on upon being touched by the loaded paper cassette 40, or may be an optical sensor or another kind of sensor. When the paper cassette 40 is removed after the printer is powered, for replacement of the recording sheet package 10 or for other reasons, the cassette sensor 101 detects the paper cassette 40 being reloaded. When the paper cassette 40 is reloaded, the paper supply rollers 21 are reversely rotated for a period in the paper feeding position to execute the returning mode, like when the printer starts being powered. There after when a print start signal is entered, the recording sheet 12 is supplied, and the three-color frame sequential printing is carried out, in the same way as in the above embodiment.

Figure 17:
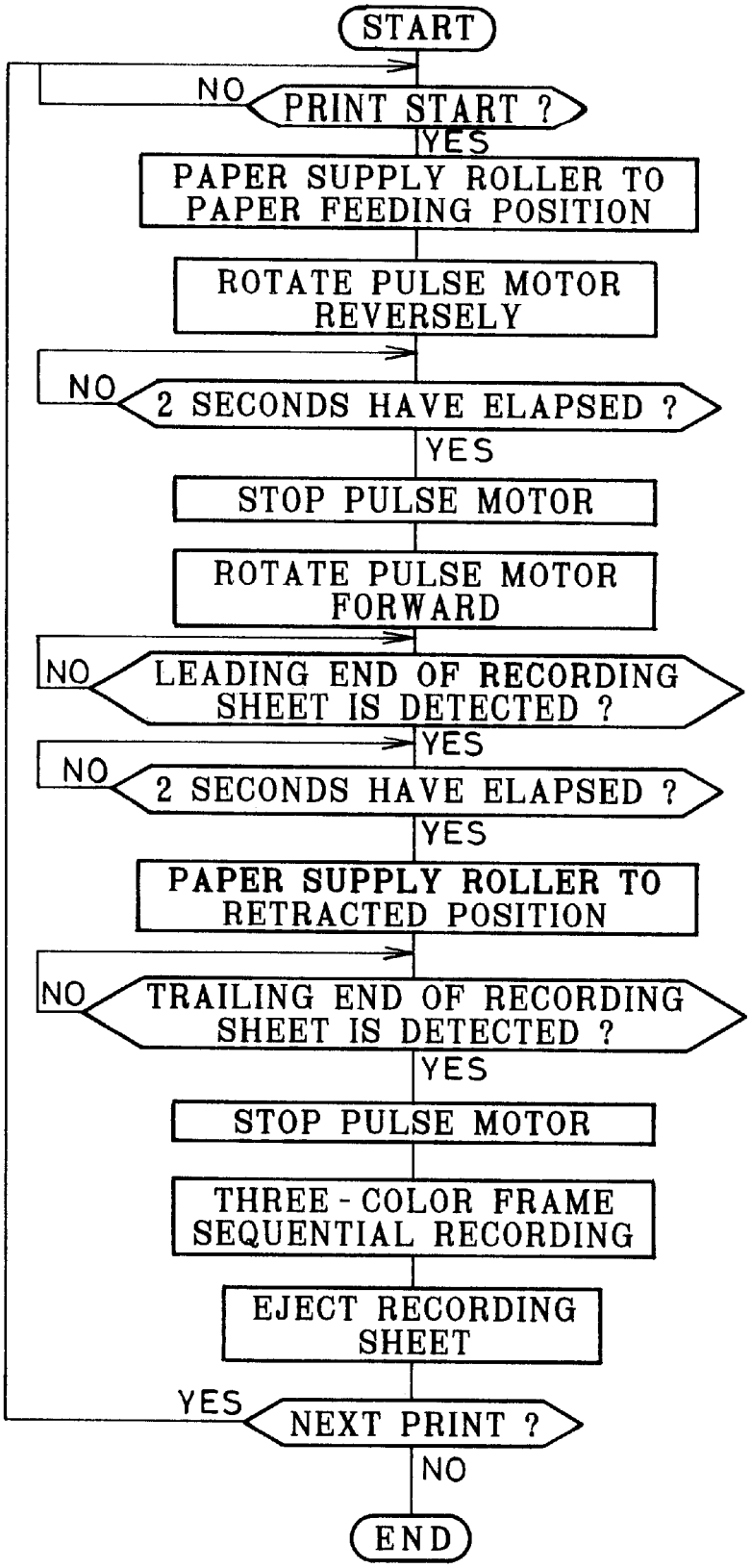
FIG. 17 is a flow chart illustrating an operation of a thermosensitive printer that carries out the resetting mode immediately before starting printing, according to a fifth embodiment of the present invention.

FIG. 17 shows a flow chart of another embodiment wherein the returning mode for returning the recording sheet is executed immediately before starting printing. This embodiment also prevents multi-feeding of the recording sheet by returning the recording sheet protruded from the paper cassette or the casing for some reasons to the original position immediately before starting printing.

Instead of executing the returning mode once, i.e., immediately after the completion of printing, or at the start of powering, or at the reloading of the paper cassette, or immediately before the start of printing, it is preferable to execute the returning mode several times on some of these occasions. It is also possible to execute the returning mode on each of these occasions.

Although the recording sheet package 10 is used for loading the recording sheets 12 in the paper cassette 40 in the above embodiment, the present invention is applicable to those cases where the recording sheets 12 are directly placed in the loading section 44 without the use of the casing 11.

Although the paper supply rollers 21 are rotated reversely for a predetermined time, e.g. 2 seconds, to feed back the recording sheet 12 into the casing 11, the time duration of this reverse rotation of the paper supply rollers 21 may be modified appropriately. To make sure to return the recording sheet 12, the paper supply rollers 21 may be rotated reversely at several times. It is also possible to use the paper sensor 100, as shown in FIG. 14, for checking if the recording sheet 12 is fed back into the casing 11 or not, so as to continue rotating the paper supply rollers 21 reversely till the recording sheet 12 is fed back into the casing 11.

Figure 18:
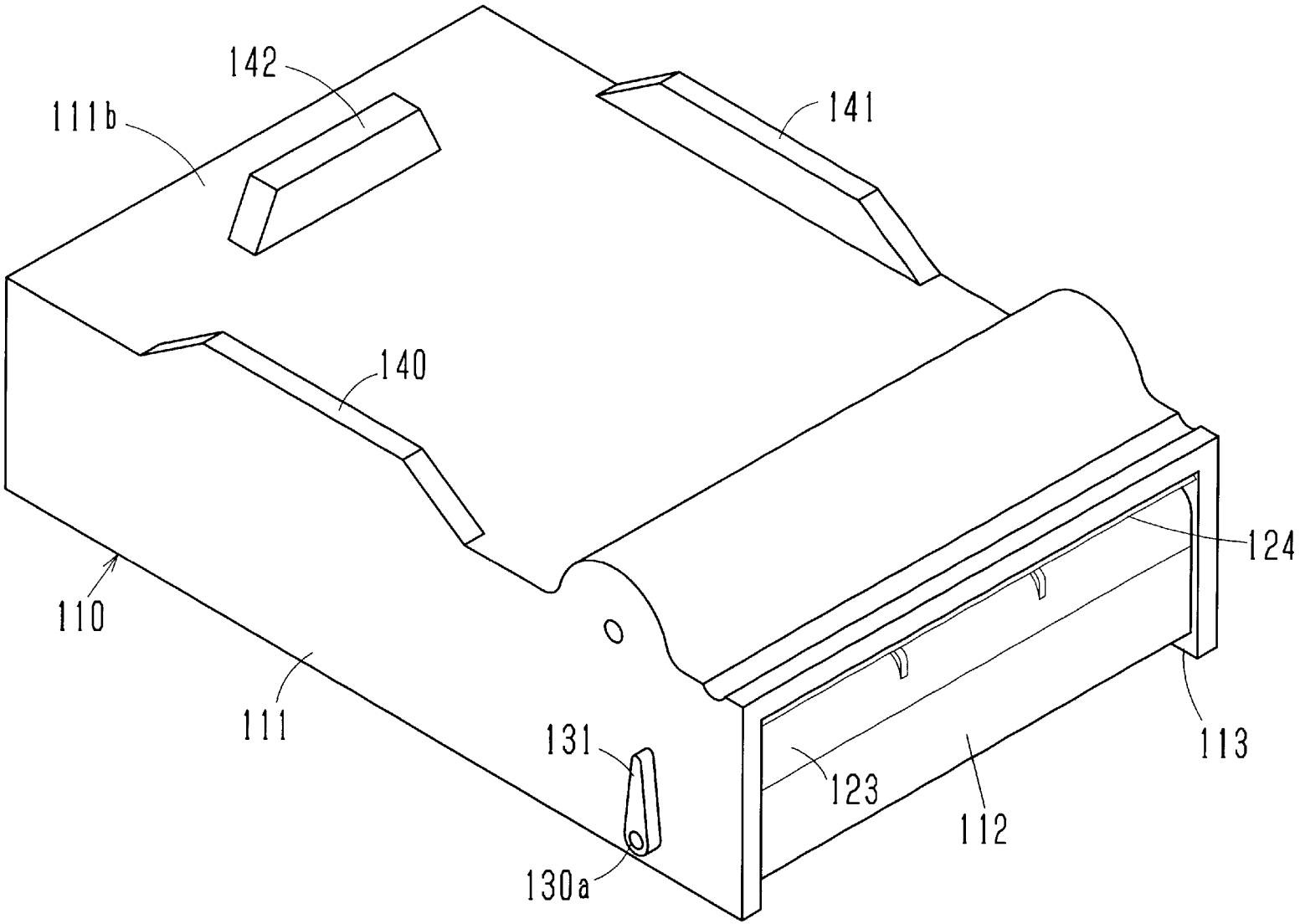
FIG. 18 is a perspective view illustrating an appearance of a paper cassette viewed from left, according to the present invention.
Figure 19:
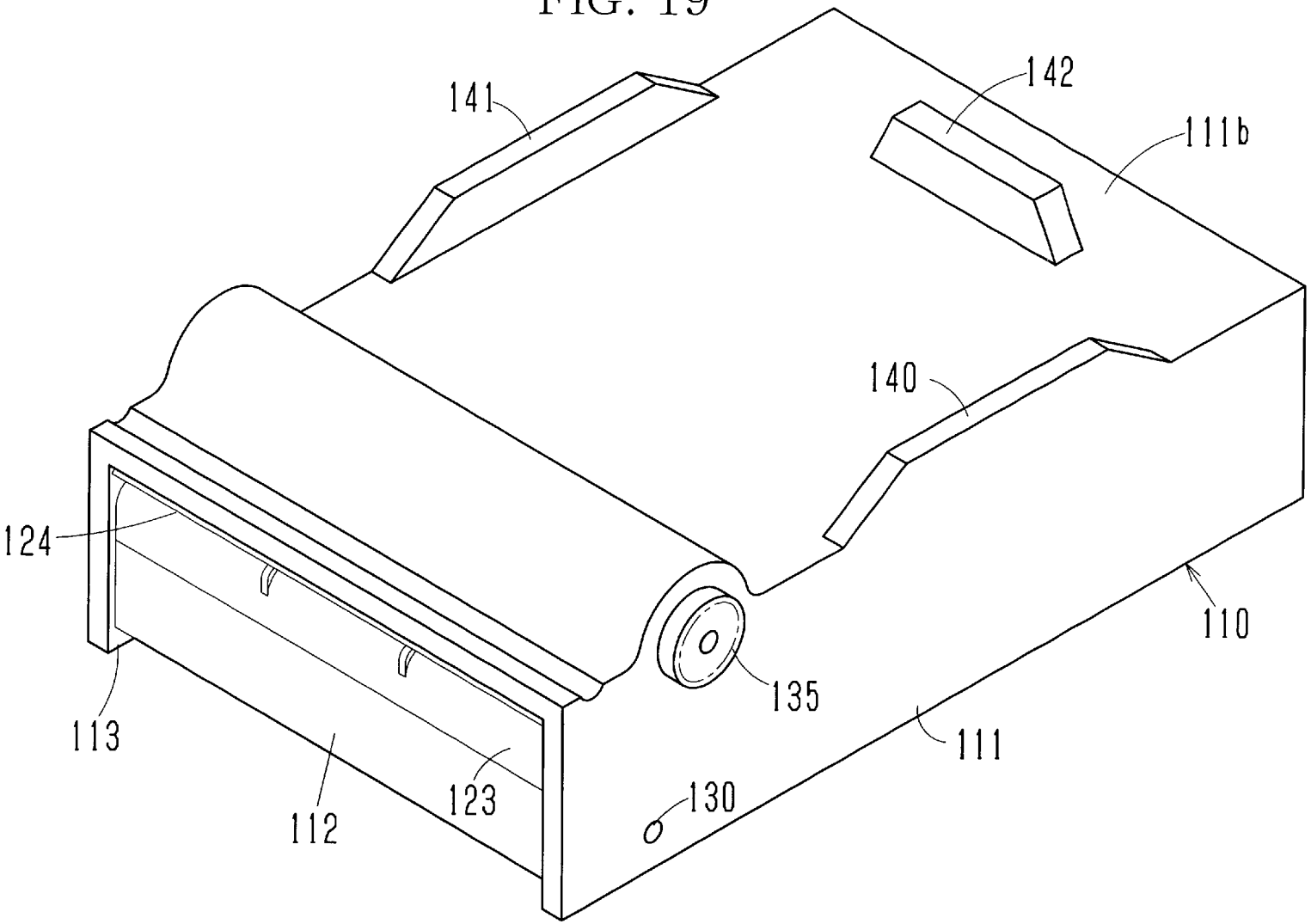
FIG. 19 is a perspective view illustrating an appearance of the paper cassette of FIG. 18, viewed from right.

FIGS. 18 and 19 show the appearance of a paper cassette 110 with paper supply rollers 120, according to another embodiment of the present invention. The paper cassette 110 consists of a cassette body 111 and a recording sheet separator 112 that functions also as a lid. The cassette body 11 has a thin parallelepiped shape with one end open for providing a paper supply opening 113.

Figure 20:
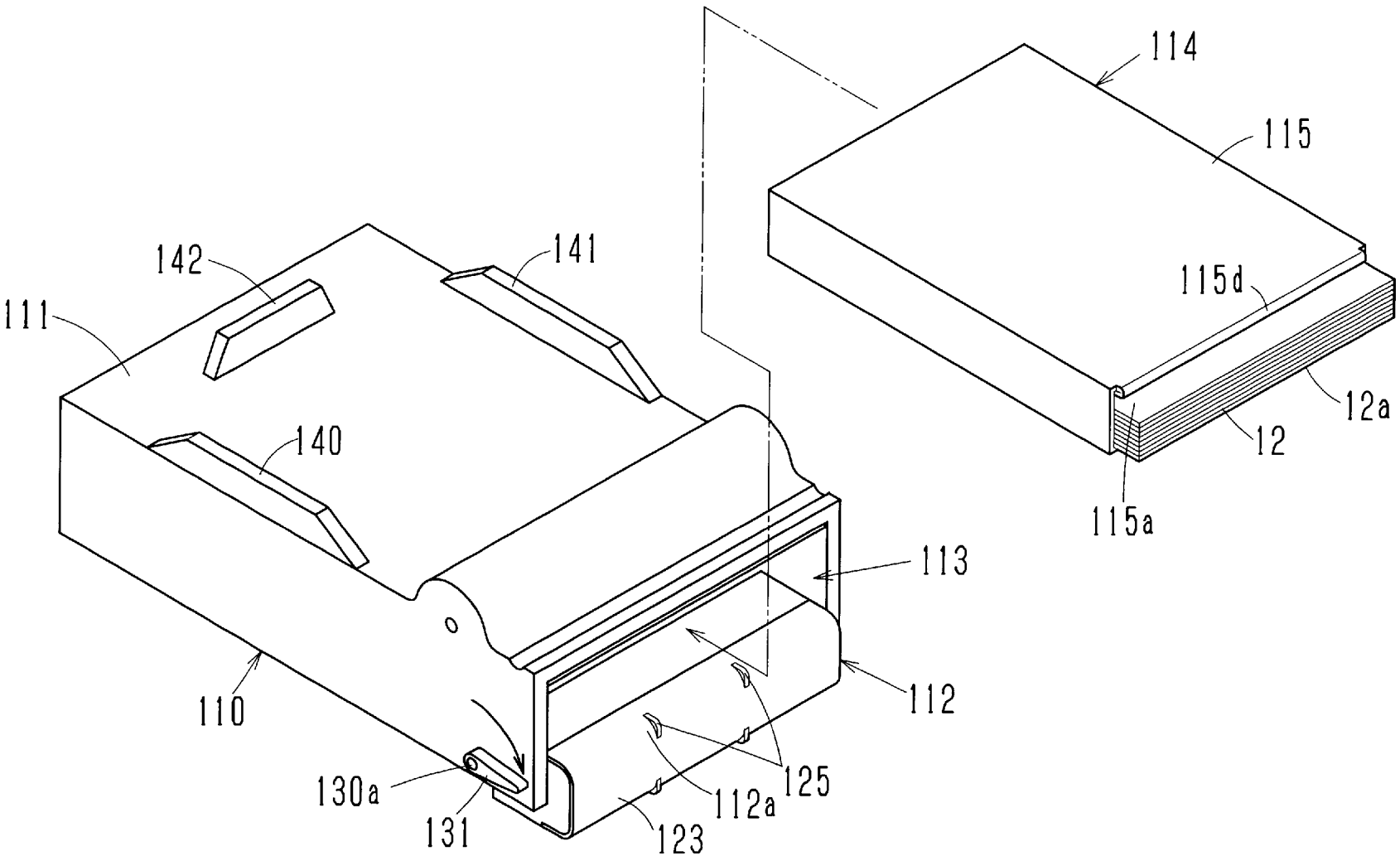
FIG. 20 is a perspective view illustrating how to load a recording sheet package in the paper cassette of FIG. 18.

As shown in FIG. 20, a recording sheet package 114 is loaded in the cassette body 111. A casing 115 of the recording sheet package 114 is formed from a thick dust-proof paper made of long fibers, and has a thin parallelepiped shape with one end open for providing a paper feed out opening 115*a*. The casing contains twenty recording sheets 12 neatly piled in a stack with their base side up and their thermosensitive coloring surfaces down. As for the thicker recording sheets that are used as stickers, ten sheets are contained in this instance. A protection sheet 12*a* is placed under the uppermost one of the recording sheets 12. The protection sheet 12*a* is laid in tight contact with the thermosensitive recording surface of the recording sheet 12, so as to protect the thermosensitive recording surface from light and moisture. The protection sheet 12*a* may be omitted.

Figure 21:
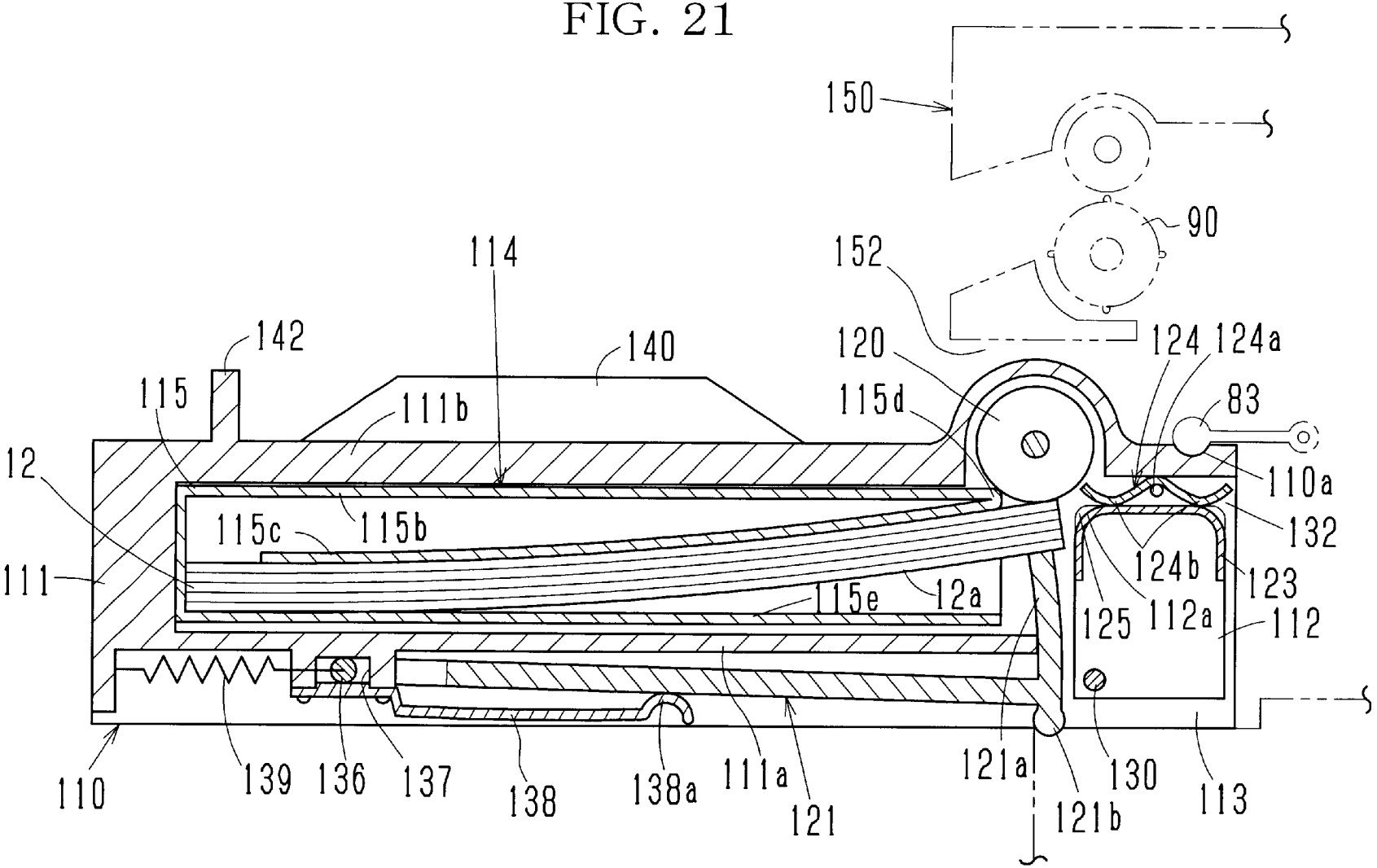
FIG. 21 is a vertical sectional view illustrating the paper cassette of FIG. 18.

As shown in FIG. 21, a pressing plate 115*c* is connected to a top plate 115*b* of the casing 115. The pressing plate 115 is placed under the top plate 115*b* by being folded along a joint to the top plate 115*b*. Because of a resiliency of a bent portion 115*d*, the pressing plate 115*c* is urged downward, so the recording sheets 12 are clamped between a bottom plate 115*e* and the pressing plate 115*c*, and thus kept in tight contact with each other.

The recording sheet separator 112 has a parallelepiped shape with upper corners rounded. A cork member 123 is cemented on the recording sheet separator 112 from an upper portion of its front face through its top side to an upper portion of its rear face. The cork member 123 cooperates with a recording sheet pressing blade 124 as set forth later, such that a lower one of two recording sheets 12 which are fed out together is stopped by friction against the cork member 123, so an upper one of the recording sheets 12 along is fed out. Although the cork member 123 covers substantially the whole surface of the upper portion of the recording sheet separator 112, the cork member 123 may be provided only in a central portion that comes into contact with the recording sheet 12.

The recording sheet separator 112 further has a pair of separating projections 125 for prevention against double-feeding. The separating projections 125 are formed to protrude vertically from the rounded corners 112*a*, so they stop a leading end of the lower one of the two recording sheets 12 which are being fed together, ensuring that the lower recording sheet is stopped from being fed out.

The recording sheet separator 112 is mounted pivotally about a mounting shaft 130 in the paper supply opening 113. The recording sheet separator 112 is movable between an upright paper separating position shown in FIG. 21, and an open position shown in FIG. 22 where the recording sheet separator 112 is turned in a clockwise direction by an angle of 90 degrees from the paper separating position. In the paper separating position, the uppermost one of the piled recording sheets 12 is allowed to pass over the recording sheet separator 112, whereas leading ends of the second and following recording sheets 12 come into contact with the recording sheet separator 112, so these sheets cannot advance any further. In the open position, the recording sheet separator 112 is retracted from the paper supply opening 113, allowing the recording sheet package 114 to be loaded through the paper supply opening 113.

To permit switching the recording sheet separator 112 between the paper separating position and the open position, an operation lever 131 is secured to an end 130*a* of the mounting shaft 130, as shown in FIG. 18. For the sake of holding the recording sheet separator 112 at the paper separating position or the open position, a not-shown click stop mechanism is provided, so the recording sheet separator 112 would not easily be displaced from the paper separating position or the open position.

In the paper separating position, as shown in FIG. 21, a paper passageway 132 is provided by a gap between the recording sheet separator 112 and a top wall 111*b* of the cassette body 111. In the paper passageway 132, the recording sheet pressing blade 124 is disposed for urging the recording sheet 12 toward the recording sheet separator 112. The recording sheet pressing blade 124 is mounted to the cassette body 111 through a mounting shaft 124*a*. The recording sheet pressing blade 124 is made of a leaf spring bent into a wavy shape, so bent portions 124*b* gently press the recording sheet 12 against the recording sheet separator 112.

The bent portions 124*b* are provided before and behind the mounting shaft 124*b* in the paper supply direction. Because the bent portions 124*b* are resiliently pressed onto the recording sheet separator 112, the paper passageway 132 is tightly closed. This blocks entrance of dusts or the like, and also increases light-tightness and moisture-tightness. Moreover, because the bent portions 124*b* close the passageway at two points, at least one of the bent portions 124*b* closes the passageway even while a leading end of the recording sheet 12 passes through.

The paper supply rollers 120 are disposed in the cassette body 111 in proximity to the paper supply opening 113. The paper supply rollers 120 is rotated in a paper supply direction for drawing out the uppermost one of the recording sheets 12, through a drive gear 135 (see FIG. 19) that is driven by a thermal printer as attached with the paper cassette 110.

As shown in FIG. 21, a recording sheet urging plate 121 is pivotally mounted to a bottom wall 111*a* of the cassette body 111 through a mounting shaft 136. Also a pressing spring 138 is mounted to the bottom wall 111*a* in a way to close a bearing portion 137 that holds the mounting shaft 136 such that the mounting shaft 136 may turn therein. A distal end 138*a* of the pressing spring 138 is in contact with the bottom side of the recording sheet urging plate 121, to urge the recording sheet urging plate 121 upward. The casing 115 has a shorter length in the paper supply direction than the recording sheet 12, so leading ends of the recording sheets 12 protrude from the casing 115. Where the recording sheet package 114 is loaded in the cassette body 111, the protruded leading ends of the recording sheets 12 are pushed from the top as well as from the bottom respectively by the paper supply rollers 120 and by an end of an urging ridge 121*a* of the recording sheet urging plate 121. In this way, the recording sheets 12 are urged toward the paper supply rollers 120, so the uppermost one of the recording sheets 12 is pressed onto the paper supply rollers 120. The urging ridge 121*a* is formed on an distal end of the recording sheet urging plate 121, to protrude upward. The end edge of the urging ridge 121*a* comes into contact with the bottom side of the leading end of the recording sheet 12.

The mounting shaft 136 of the recording sheet urging plate 121 is urged by a coiled spring 139 to move in an opposite direction to the paper supply direction, (to the left in FIG. 21). The bearing portion 137 is elongated in the paper supply direction, so the mounting shaft 136 is movable in the paper supply direction inside the bearing portion 137. Furthermore, the recording sheet urging plate 121 has a knob 121*b* that protrudes oppositely to the urging ridge 121*a*.

The recording sheet urging plate 121 may be pulled down while pinching the knob 121*b*. When the end of the urging ridge 121*a* of the recording sheet urging plate 121 is placed under the bottom wall 111*a*, the recording sheet urging plate 121 moves to the left according to the force of the coiled spring 139, so the end of the urging ridge 121*a* is brought into contact with the bottom wall 111*a*. Thus, the recording sheet urging plate 121 cannot return to an urging position, but is held in an open position where the urging ridge 121*a* is retracted from the paper supply opening 113.

When the recording sheet separator 112 is switched to the open position, as shown in FIG. 20, the paper supply opening 113 is opened up, allowing loading the recording sheet package 114. After the recording sheet package 114 is loaded in the paper cassette 110, the operation lever 131 is erected to set the recording sheet separator 112 back to the paper separating position. The recording sheet urging plate 121 is then shifted in the paper supply direction by hand while pinching the knob 121*b*. Then the urging ridge 121*a* of the recording sheet urging plate 121 passes over an end of the bottom wall 111*a*, so the recording sheet urging plate 121 swings toward the paper supply opening 112. Thus, the urging ridge 121*a* is brought into contact with the bottom of the leading end of the recording sheet, as shown in FIG. 21, urging the recording sheets 12 to the paper supply rollers 120.

Figure 22:
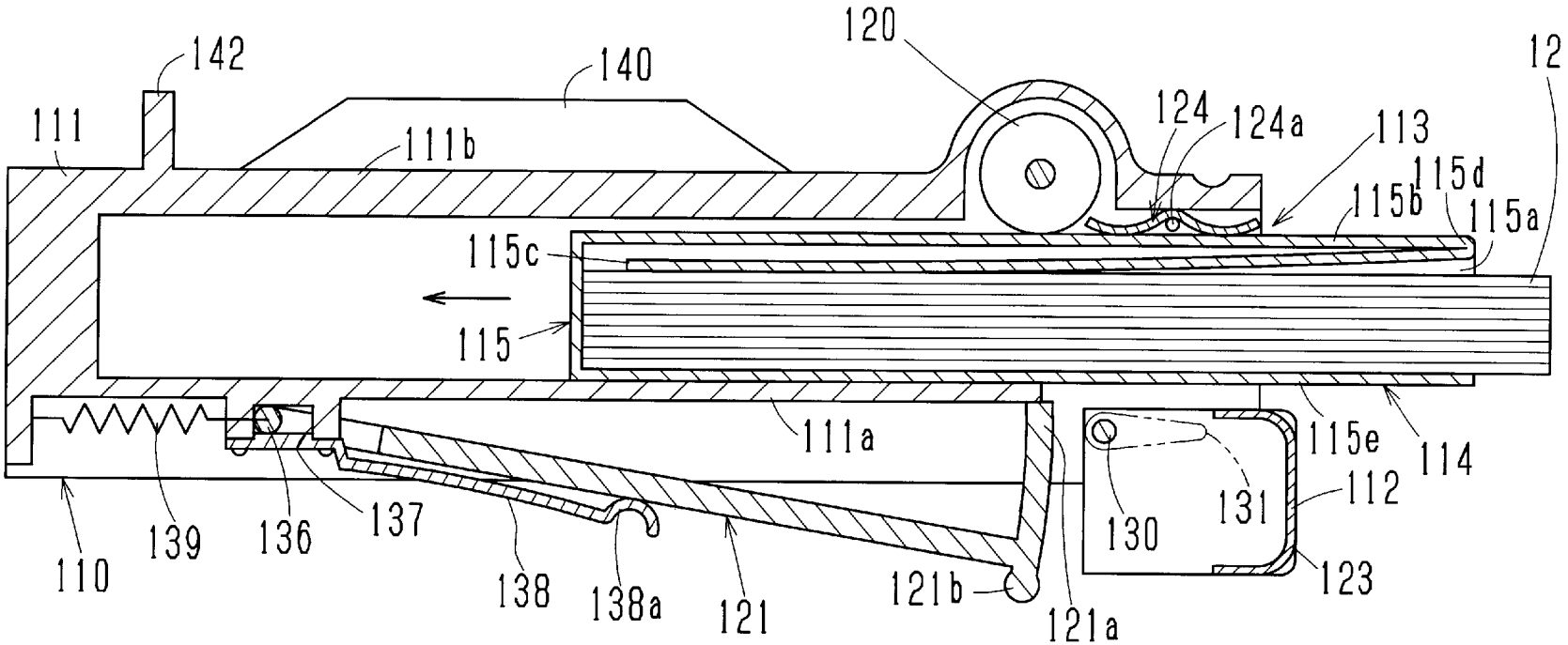
FIG. 22 is a vertical sectional view illustrating the paper cassette of FIG. 18, in a condition where the recording sheet package is being loaded.

For loading the recording sheet package 114 in the paper cassette 110, it is possible to set the recording sheet separator 112 from the paper separating position to the open position first, and then set the recording sheet urging plate 121 to the retracted position (see FIG. 22).

As shown in FIG. 18, a top wall 111*b* of the cassette body 111 doubles as a paper ejection tray, so paper guides 140 and 141 and a stopper 142 are protruded from the top wall 111*b*. The paper guides 140 and 141 are for guiding the recording sheet 12 at its lateral sides, and are formed along the length of the top wall 111*b*. The stopper 142 is for stopping the recording sheet 12 at its leading end, and preventing it from slipping off the top wall 111*b*.

When the paper cassette 110 is inserted into an inlet 152 of a thermosensitive printer 150, as shown in FIG. 21, a click engagement member 83 is engaged in an engaging recess 110*a* of the paper cassette 110, preventing the paper cassette 110 from dropping off the thermosensitive printer 150. On printing, the paper supply rollers 120 rotate in the paper supply direction (counterclockwise direction) to withdraw the uppermost one of the recording sheets 12 from the recording sheet package 112 in the paper cassette 110, and feed it into the printer 150, for subjecting it to the well-known three-color frame sequential printing. At the conclusion of printing, the recording sheet 12 is ejected onto the top wall 111*b* of the cassette body 111 through ejection rollers 90 that are provided in the thermosensitive printer.

Figure 23:
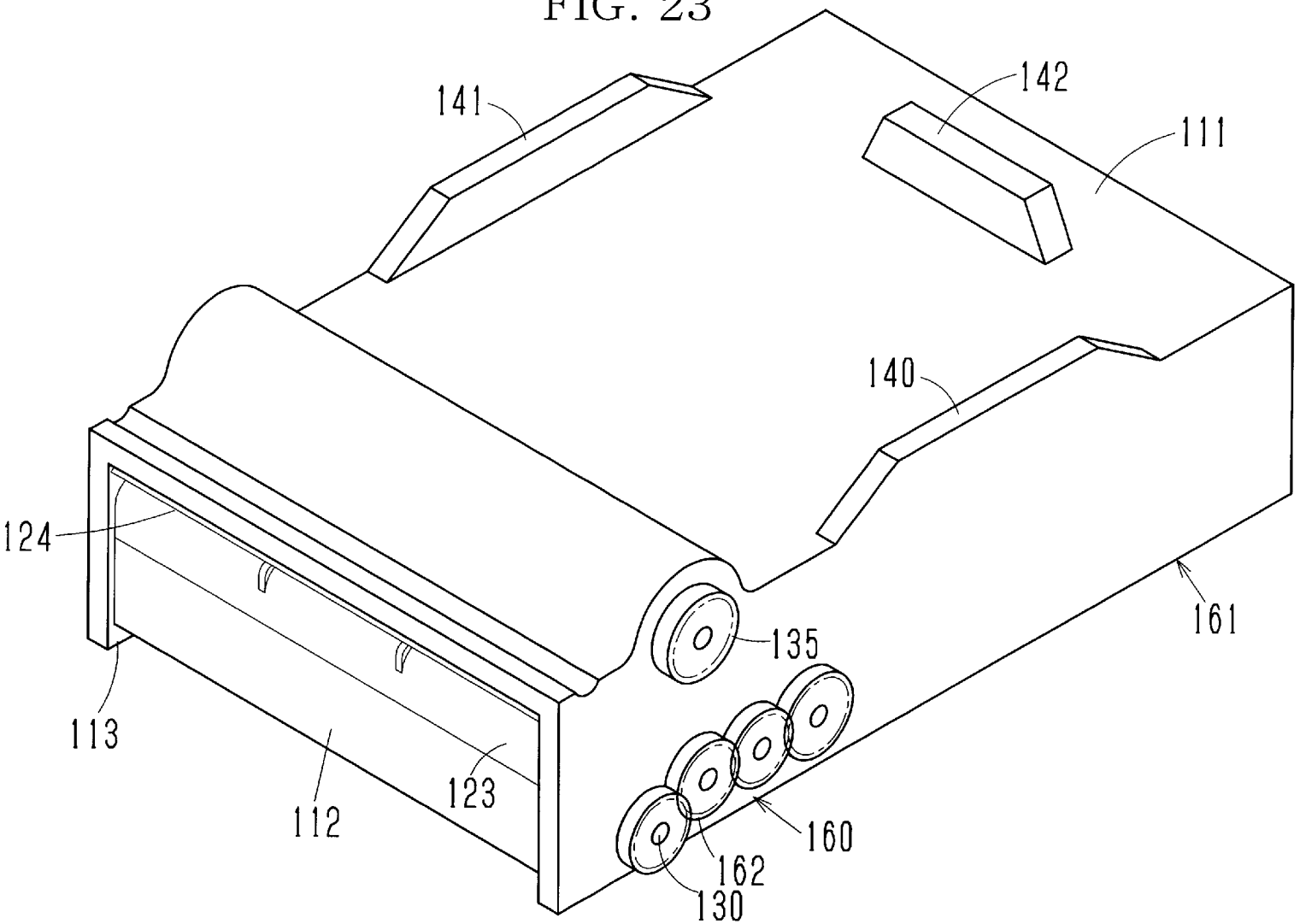
FIG. 23 is a perspective view illustrating the paper cassette of FIG. 18, in a condition attached to a thermosensitive printer.

In the above embodiment, the recording sheet urging plate 121 is moved from the urging position to the arrested position by pinching at the knob 121*b*. In an alternative shown in FIGS. 23 to 25, a recording sheet urging plate 121 is moved in cooperation with a recording sheet separator 112 through an interconnection mechanism 160. In this case, a gear train 162 is disposed at an opposite end of a mounting shaft 130 from an operation lever 131 of a paper cassette 161, as shown in FIG. 23, so as to transmit rotational movement of the recording sheet separator 112 to an urging plate displacing lever 163 shown in FIG. 24. It is to be noted the same elements as used in the above embodiment are designated by the same reference numbers, so as to avoid redundant descriptions of these elements.

Figure 24:
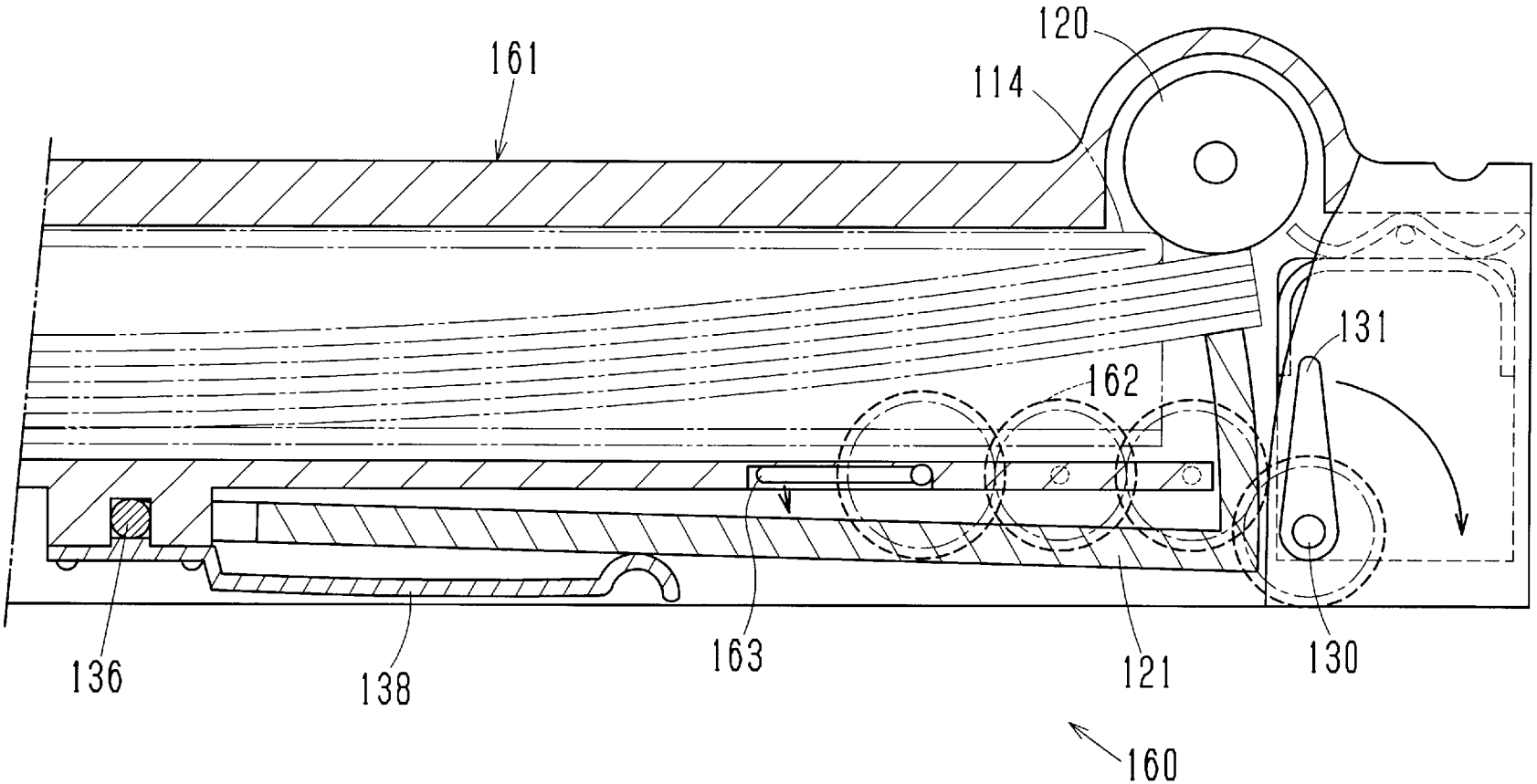
FIG. 24 is a perspective view illustrating a paper cassette according to another embodiment, that is provided with an interconnection mechanism for interconnecting a recording sheet separator and a paper pressing plate.
Figure 25:
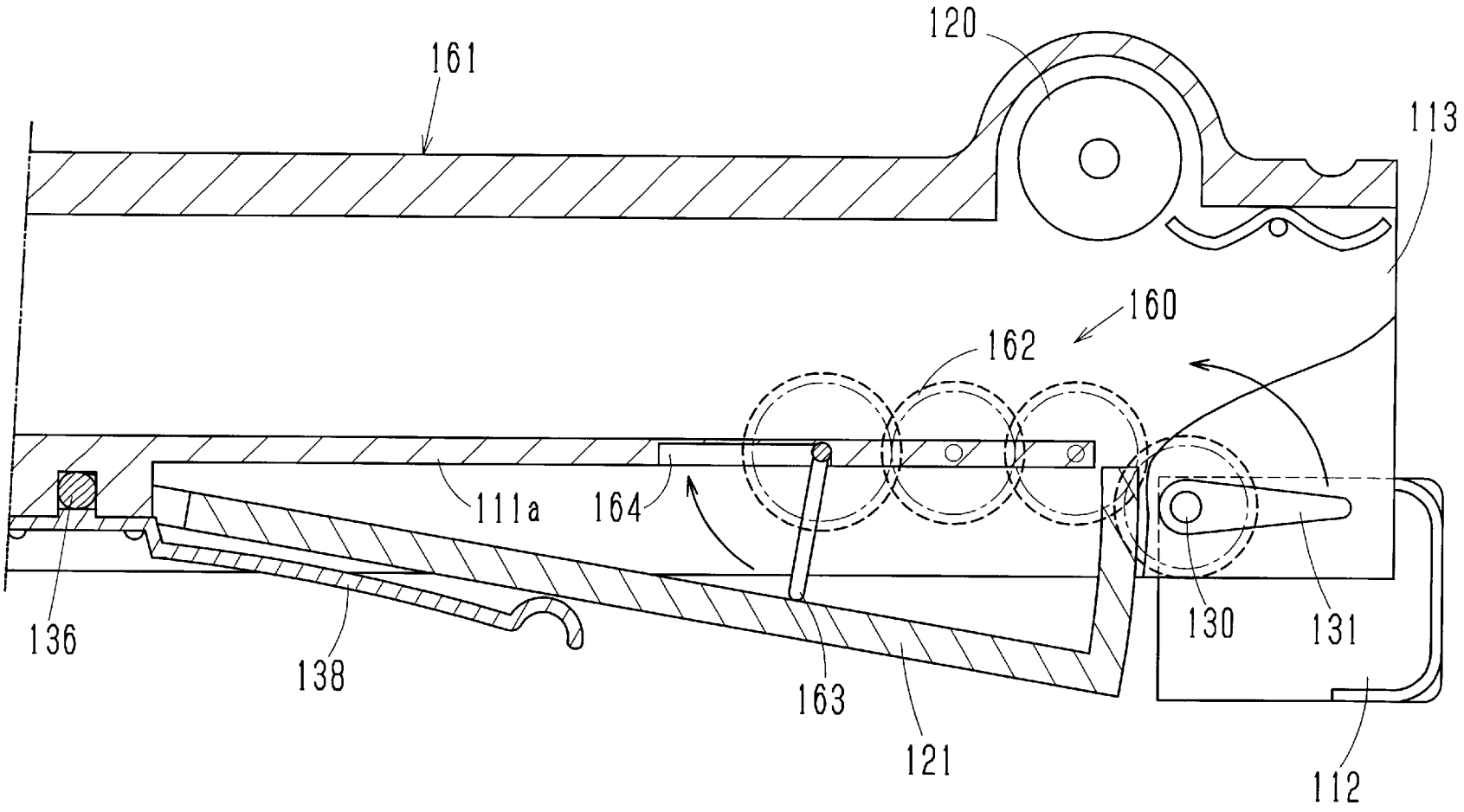
FIG. 25 is a fragmentary sectional view illustrating an operation of the interconnection mechanism, wherein the recording sheet separator of the paper cassette of FIG. 24 is in an open position.

Upon the recording sheet separator 112 being turned from a paper separating position shown in FIG. 24 to an open position shown in FIG. 25 by rotating an operation lever 131 in a clockwise direction, the rotational movement of the recording sheet separator 112 is transmitted through the gear train 162 to the displacing lever 163. Then, the displacing lever 163 is turned counterclockwise, displacing the recording sheet urging plate 121 from an urging position shown in FIG. 24 to a retracted position shown in FIG. 25. Because an urging ridge 121*a* is retracted along with the recording sheet separator 112 from a paper supply opening 113, loading of the recording sheet package 114 into the paper cassette 160 is made easier. By operating the operation lever 131 to turn the recording sheet separator 112 from the open position to the paper separating position, the turning movement is transmitted to the displacing lever 163 through the gear train 162, causing the displacing lever 163 to turn in the clockwise direction till the displacing lever 163 is put in an accommodation recess 164. Since the displacing lever 163 does not push down the recording sheet urging plate 121, the recording sheet urging plate 121 returns from the retracted position to the urging position according to a force of a pressing spring 138.

Although the recording sheet separator 112 is cooperated with the recording sheet urging plate 121 through the gear train 162 in the above embodiment, they may be cooperated with each other through another interconnection device, such as a link mechanism. Although the operation lever 131 is used for displacing the recording sheet separator 112, the operation lever 131 may be omitted. In that case, the recording sheet separator 112 is turned directly by hands.

Figure 26:
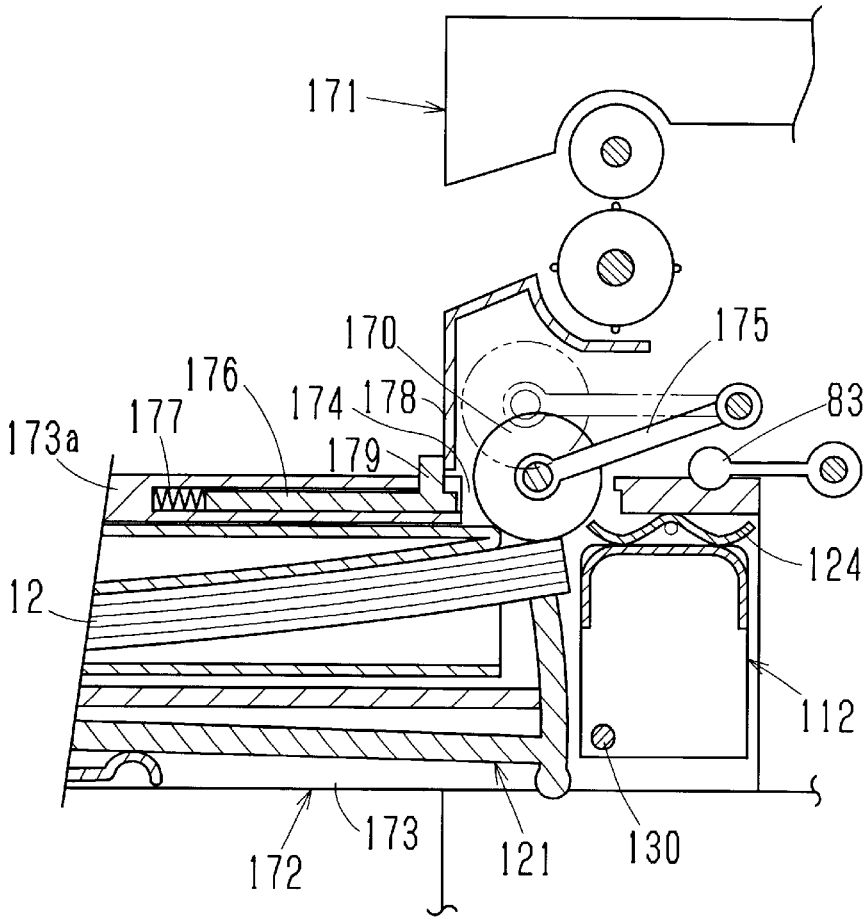
FIG. 26 is a sectional view illustrating essential parts of a paper cassette according to a further embodiment, attached to a thermosensitive printer.
Figure 27:
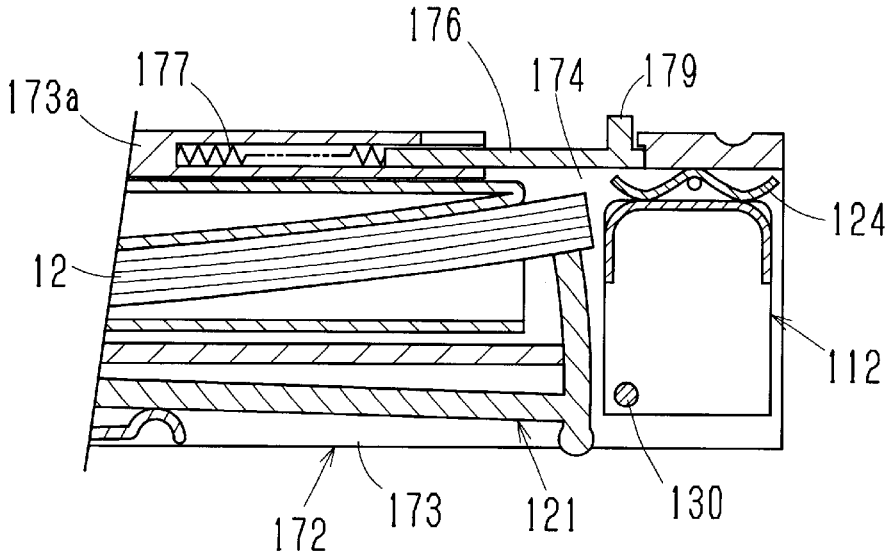
FIG. 27 is a sectional view illustrating the essential parts of the paper cassette of FIG. 26, detached from the thermosensitive printer.

In the above embodiment, the paper supply rollers 120 are incorporated into the paper cassette 110, so the paper cassette does not need any roller opening for letting the paper supply rollers into it, and is therefore improved in light-tightness and moisture-tightness. However, it is possible to provide paper supply rollers 170 in a thermosensitive printer 171, in a way as shown in FIG. 26, wherein the same elements as used in the above embodiment are designated by the same reference numbers. In this embodiment, a roller opening 174 is formed through a cassette body 173 of a paper cassette 172. The paper supply rollers 170 are held on roller holding arms 175. By moving the roller holding arms 175, the paper supply rollers 170 are moved between a paper supply position (shown by solid lines) where the paper supply rollers 170 are inserted in the cassette body 173 through the roller opening 174, and a retracted position (shown by phantom lines) retracted from the cassette body 173. In the paper supply position, the paper supply rollers 170 are rotated in a paper supply direction to feed out the recording sheet.

To improve the light-tightness and the moisture-tightness, a sliding lid 176 is provided for opening and closing the roller opening 174. The sliding lid 176 is mounted to a top wall 173*a* of the cassette body 173 such that the sliding lid 176 may slide in a paper supply direction. The sliding lid 176 is urged by a coiled spring 177 in the paper supply direction, so the sliding lid 176 closes the roller opening 174 when the paper cassette 172 is detached from the thermosensitive printer 171. The sliding lid 176 has an engaging ridge 179 formed on upside of its leading end. The engaging ridge 179 is brought into contact with a frame 178 of the thermosensitive printer 178.

Accordingly, as the cassette body 173 is inserted into a cassette inlet of the thermosensitive printer 171, the sliding lid 176 is opened because the engaging ridge 179 is stopped against the frame 178. When the cassette body 173 is completely inserted into the inlet, a click stopping member 83 holds the paper cassette 172 securely in a loaded position. In this position, the paper supply rollers 170 enter through the roller opening 174, and come to contact with the uppermost one of the recording sheets 12, for feeding it out.

According to this embodiment, while the paper cassette 172 is not loaded in the thermosensitive printer 171, the sliding lid 176 is kept in the closed position by the urging force of the coiled spring 177, so light and moisture would not enter the cassette body 173 through the roller opening 174. By setting the paper cassette 172 in the thermosensitive printer 171, the sliding lid 176 is automatically opened, so the paper supply rollers 170 may be placed in a paper supply position through the roller opening 174.

It is preferable to use at least one of the paper feeding methods of the embodiments shown in FIGS. 13 to 17, for feeding out the recording sheet from the paper cassettes shown in FIGS. 18 to 27, because it prevents multi-feeding and provides better light- and moisture-tightness for the recording sheets.

Although the recording sheets loaded in the paper cassette are fed out one by one from the uppermost one in the above embodiments, the present invention is applicable to those cases where the recording sheets are fed out sequentially from the lowermost one. In that case, a paper passageway is provided on the side of the bottom wall of the paper cassette, and paper supply rollers are pressed onto the lowermost one of the recording sheets and rotated to feed it out.

Thus, the present invention is not to be limited to the above embodiments, but various modifications are possible without departing from the scope of claims.

INDUSTRIAL APPLICATION FIELD

The present invention is not only applicable to those printers and paper cassettes which use the thermosensitive recording sheets, but also to those printers and paper cassettes which use the sublimation type recording sheets or melting type recording sheets. Moreover, the present invention is applicable to printers of other printing types, such as an ink-jet type and a laser-printing type, and to paper cassettes for these printers.

What is claimed is:

1. A paper supplying method for supplying recording sheets having at least a thermosensitive coloring layer formed thereon, one by one from a paper cassette to a printer, comprising the steps of:

attaching the paper cassette to the printer, the paper cassette being loaded with the recording sheets piled up in a stack with their thermosensitive coloring layers oriented downward;

making the paper supply rollers and the recording sheet in the paper cassette contact in response to a print start command;

rotating the paper supply rollers in a paper supply direction to feed the recording sheet into the printer;

making the paper supply rollers and the recording sheet in the paper cassette contact-free after an end of paper supply;

making the paper supply rollers and the recording sheet in the paper cassette contact after an end of recording images on the recording sheet; and rotating the paper supply rollers in a direction reverse to the paper supply direction, to return other recording sheets to a predetermined paper supply start position inside the paper cassette.

2. A paper supplying method for supplying recording sheets having at least a thermosensitive coloring layer formed thereon, one by one from a paper cassette to a printer, comprising the steps of:

attaching the paper cassette to the printer, the paper cassette being loaded with the recording sheets piled up in a stack with their thermosensitive coloring layers oriented downward;

making the paper supply rollers and the recording sheet in the paper cassette contact in response to a print start command;

rotating the paper supply rollers in a paper supply direction to feed the recording sheet into the printer;

making the paper supply rollers and the recording sheet in the paper cassette contact-free after an end of paper supply;

detecting those recording sheets which protrude from a predetermined paper supply start position inside the paper cassette;

making the paper supply rollers and the recording sheet in the paper cassette contact after an end of recording images on the recording sheet when it is detected that some of the recording sheets protrude from the paper supply start position; and rotating the paper supply rollers in a direction reverse to the paper supply direction thereby to return these recording sheets to the paper supply start position.

3. A paper supplying method for supplying a printer with recording sheets one by one from a paper cassette that is loaded with a stack of recording sheets, comprising the steps:

rotating the paper supply rollers in a paper supply direction to feed the recording sheet into the printer in response to a print start command;

detecting that the paper cassette is loaded in the printer; and rotating the paper supply rollers in a direction reverse to the paper supply direction to return the recording sheets to a predetermined paper supply start position inside the paper cassette at each detection of loading the paper cassette.

4. A paper supplying method for supplying recording sheets having at least a thermosensitive coloring layer formed thereon, one by one from a paper cassette to a printer, comprising the steps of:

attaching the paper cassette to the printer, the paper cassette being loaded with the recording sheets piled up in a stack with their thermosensitive coloring layers oriented downward;

contacting the paper supply rollers to a first recording sheet in the paper cassette in response to a print start command;

rotating the paper supply rollers in a paper supply direction to feed the first recording sheet into the printer;

retracting the paper supply rollers from the recording sheets in the paper cassette after an end of paper supply;

contacting the paper supply rollers to at least one other recording sheet in the paper cassette after an end of recording images on the first recording sheet; and rotating the paper supply rollers in a direction reverse to the paper supply direction, to return the at least one other recording sheet to a predetermined paper supply start position inside the paper cassette.

5. A paper supplying method for supplying recording sheets having at least a thermosensitive coloring layer formed thereon, one by one from a paper cassette to a printer, comprising the steps of:

attaching the paper cassette to the printer, the paper cassette being loaded with the recording sheets piled up in a stack with their thermosensitive coloring layers oriented downward;

contacting the paper supply rollers to a first recording sheet in the paper cassette in response to a print start command;

rotating the paper supply rollers in a paper supply direction to feed the first recording sheet into the printer;

retracting the paper supply rollers from the recording sheets in the paper cassette after an end of paper supply;

detecting those recording sheets which protrude from a predetermined paper supply start position inside the paper cassette;

contacting the paper supply rollers to the recording sheets in the paper cassette after an end of recording images on the first recording sheet when it is detected that some of the recording sheets protrude from the paper supply start position; and rotating the paper supply rollers in a direction reverse to the paper supply direction for returning the recording sheets, which have been detected as protruding from the paper supply start position, back to the paper supply start position.

* * * * *